US011286683B2

(12) United States Patent
Mashal

(10) Patent No.: US 11,286,683 B2
(45) Date of Patent: Mar. 29, 2022

(54) DUCTILE CONNECTIONS FOR PRE-FORMED CONSTRUCTION ELEMENTS

(71) Applicant: IDAHO STATE UNIVERSITY, Pocatello, ID (US)

(72) Inventor: Mustafa Mashal, Pocatello, ID (US)

(73) Assignee: Idaho State University, Pocatello, ID (US)

( * ) Notice: Subject to any disclaimer, the term of this patent is extended or adjusted under 35 U.S.C. 154(b) by 0 days.

(21) Appl. No.: 16/817,042

(22) Filed: Mar. 12, 2020

(65) Prior Publication Data

US 2020/0291646 A1 Sep. 17, 2020

Related U.S. Application Data

(60) Provisional application No. 62/817,134, filed on Mar. 12, 2019, provisional application No. 62/883,173, filed on Aug. 6, 2019.

(51) Int. Cl.

| | |
|---|---|
| ***E04H 9/02*** | (2006.01) |
| ***E04B 2/62*** | (2006.01) |
| ***E01D 19/06*** | (2006.01) |

(52) U.S. Cl.

CPC ..... *E04H 9/0215* (2020.05); *E01D 19/06* (2013.01); *E04B 2/62* (2013.01); *E04H 9/024* (2013.01); *E04H 9/025* (2013.01)

(58) Field of Classification Search

CPC ..... E04H 9/0215; E04H 9/025; E04H 9/024; E04H 9/021; E04B 1/046; E04B 2/62;

(Continued)

(56) References Cited

U.S. PATENT DOCUMENTS 2,220,628 A * 11/1940 Stedman ..... E01C 11/106 404/47
6,666,618 B1 * 12/2003 Anaya ..... E01D 19/06 14/73.1

(Continued)

FOREIGN PATENT DOCUMENTS

CN 105464227 A * 4/2016
CN 106436918 A * 2/2017

(Continued)

OTHER PUBLICATIONS

ASCE Standard. "Minimum Design Loads and Associated Criteria for Buildings and Other Structures" *ASCE/SEI* 7-16 (2017) pp. 1-847.

(Continued)

*Primary Examiner* — Brent W Herring
(74) *Attorney, Agent, or Firm* — Dority & Manning, P.A.

(57) ABSTRACT

Precast construction elements are described suitable for use in high seismic area. The precast construction elements can be precast, pre-topped double tees. The precast construction elements incorporate a passive energy dissipation device in a flange. The energy dissipation device provides a ductile connection having a deformation capacity of larger than 0.6". Adjacent elements are connected to one another at joints that include the passive energy dissipation device. Passive energy dissipation devices can be passive hysteretic dampeners, such as U-shaped flexural plates. Passive energy dissipation devices can be bar dissipaters (e.g., grooved dissipaters). Also described are passive hysteretic dampers that include U-shaped flexural plates held in conjunction with a reinforcement element that defines a circle around which the flexural plate can bend.

21 Claims, 35 Drawing Sheets

(58) Field of Classification Search
CPC .... E04B 1/98; E01D 19/06; F16F 7/08; F16F 3/12; F16F 7/116; E01C 11/02
USPC ... 52/167.1, 167.3, 167.4, 393, 394, 396.03, 52/396.07, 167.7, 167.8; 267/140.11
See application file for complete search history.

(56) References Cited

U.S. PATENT DOCUMENTS

| | | | | |
|---|---|---|---|---|
| 8,221,030 | B1 * | 7/2012 | Haydu | E03B 11/00 405/70 |
| 8,468,766 | B1 | 6/2013 | Keenan | |
| 9,340,978 | B2 | 5/2016 | Naito | |
| 2004/0187235 | A1 * | 9/2004 | Elias | E01C 11/12 14/73.1 |
| 2010/0186316 | A1 | 7/2010 | Buchanan et al. | |
| 2018/0105135 | A1 | 4/2018 | Keats et al. | |

FOREIGN PATENT DOCUMENTS

| | | | | |
|---|---|---|---|---|
| CN | 108798176 A * | 11/2018 | | |
| CN | 108867923 A * | 11/2018 | | |
| CN | 108867925 A * | 11/2018 | | |
| CN | 108951926 A * | 12/2018 | | |
| CN | 111877151 A * | 11/2020 | | |
| FR | 2694580 A1 * | 2/1994 | | E01D 19/06 |
| KR | 101005492 B1 * | 1/2011 | | |
| WO | WO 2016/167670 | 10/2016 | | |
| WO | WO-2017047867 A1 * | 3/2017 | | E01D 19/06 |

OTHER PUBLICATIONS

Baird, et al. "Experimental and Numerical Study of U-Shape Flexural Plate (UFP) Dissipators" *NZSEE Conf.* P2 (2014) pp. 1-9.
Ghosh, et al. "NEHRP Seismic Design Technical Brief No. 13: Seismic Design of Precast Concrete Diaphragms" *Appl. Techn. Counc.* NIST GCR 17-917-47 (2017) pp. 1-45.
Kelly, et al. "Mechanisms of Energy Absorption in Special Devices for Use in Earthquake Resistant Structures" *NZ Soc. Earthquake Eng.* 5(3) (1972) pp. 63-88.
Mashal, et al. "Experimental Testing and Analytical Modelling of Grooved Dissipaters" *NZSEE Conf.* 186 (2019) pp. 1-10.
Mashal, et al. "Innovative metallic dissipaters for earthquake protection of structural and non-structural components" *Soil Dynam. Earthquake Eng.* 116 (2019) pp. 31-42.
Meadow Burke®. "Seismic Chord Connector" *Meadow Burke®* MB0816 (2016) pp. 1-8.
Mesa, A.D.A. "Developments of Advanced Solutions for Seismic Resisting Precast Concrete Frames" U. Canterbury (2010) pp. 1-354.
Moehle, et al. "NEHRP Seismic Design Techmeal Brief No. 3: Seismic Design of Cast-in-Place Concrete Diaphragms, Chords, and Collectors" *Appl. Techn. Counc.* NIST GCR 16-917-42 (2016) pp. 1-43.
Pincheira, et al. "Behavior of Double-Tee Flange Connectors Subjected to In-Place Monotonic and Reversed Cyclic Loads" *PCI J.* 50(6) (2005) pp. 32-54.
Sarti, et al. "Experimental and analytical study of replaceable Buckling-Restrained Fuse-type (BRF) mild steel dissipaters" *NZSEE Conf.* (2013) pp. 1-8.
Skinner, et al. "Hysteretic Dampers for Earthquake-Resistant Structures" *Earthquake Eng. Struct. Dynam.* 3 (1975) pp. 287-296.
Wang, et al. "Superelastic SMA U-shaped dampers with self-centering functions" *Smart Mater. Struct.* 27:055003 (2018) pp. 1-14.

* cited by examiner (a)

(b)

DUCTILE CONNECTIONS FOR PRE-FORMED CONSTRUCTION ELEMENTS

CROSS REFERENCE TO RELATED APPLICATION

This application claims filing benefit of U.S. Provisional Patent Application Ser. No. 62/817,134, having a filing date of Mar. 12, 2019, and U.S. Provisional Patent Application Ser. No. 62/883,173, having a filing date of Aug. 6, 2019, both of which are incorporated herein by reference in their entirety.

BACKGROUND

Pre-formed construction elements, such as precast pre-topped double tee concrete spans, an example of which is illustrated in FIG. 1, and other engineered, pre-formed load-bearing construction elements such as pre-formed wood columns, beams, and load-bearing panels, have proven of great benefit in the construction industry. As illustrated in FIG. 1, a double tee span 10 generally includes a flange 12 that can form a load-bearing surface during use (e.g., a horizontal or inclined floor or parking deck) and two webs 14 that are perpendicular to the flange 12. A double tee beam can be topped with an upper surface that can be precast as an integral part of the structure or can be formed at the construction site.

As illustrated in FIG. 2, pre-formed construction elements such as precast pre-topped double tee spans 10 can be joined at flanges 12 with mechanical connectors 16 that are formed into the structures and used for joining adjacent pieces to one another. Through pre-formation of the connectors 16 within the structures, both time and money can be saved during construction. Connectors 16 are typically formed of metal hardware and include internal portions 15 cast into each piece during formation and a joining portion including a surface 17 for joining to an adjacent connector via, e.g., welding of a jumper plate 13. Typical connectors for concrete double tees include hairpin connectors, stud-welded deformed bar anchors, bent wings, mesh connectors, angle connectors, structural tees, bent plate connectors, and vector connectors. Different connectors vary primarily by the shape and type of the internal portions 15 and the shape, size, material, etc. of the connection surfaces 17. After erection, the first connector 16 can be utilized to connect a first flange 12 to a second flange 12 that also includes a connector 16 cast into an adjacent span 10 to form the joint 18. Double tees are common precast elements used for longer span floors and diaphragms in multi-story buildings and are often found in parking garages. The diaphragm in a structure formed of precast construction elements in particular must be strong and ductile enough to safely transfer forces to the walls and columns of the structure.

The quality of joints between construction elements is very important, particularly in forming diaphragms, as these joints must incorporate adequate connections to ensure overall structural integrity and stability, as well as to provide displacement compatibility over a long service life. Unfortunately, existing joints (e.g., jumper plate), particularly in pre-formed construction elements, have limited structural ductility and energy dissipation in natural environments that can present high stress loads on a structure, e.g., regions subject to seismic activity.

In the United States, there are three types of connections used for double tees. These include cast-in-place topped without an embedded connection; cast-in-place topped with an embedded connection; and pre-topped, precast with an embedded connection. For applications in high seismic regions, the cast-in-place options are commonly relied upon. While these selections are thought to provide adequate continuity and structural performance for a diaphragm in high seismic regions, the cast-in-place approach slows down construction, increases the superimposed dead load, and, as observed in post-earthquake inspections, is still susceptible to partial or full collapse during a large earthquake. For instance, Statistics House in Wellington, New Zealand, which was constructed in 2004/2005 with floors of double tee units with cast-in-place topping according to current best practices and thought to be earthquake safe, experienced partial collapse of the floors and, while there were no injuries in the building, the entire structure had to be demolished following the Mw 7.8 Kaikōura earthquake on Nov. 4, 2016. As a result of such occurrences, best practices now require precast concrete diaphragms in buildings assigned to Seismic Design Category (SDC) C or above to meet or exceed a new alternative determination of diaphragm design force level and to utilize a new precast diaphragm design procedure giving the designer three diaphragm design options for selecting diaphragm target performance (ASCE 7-16, § 12.10.3 and § 14.2.4), with the choice depending upon the seismic design category, the number of stories, the diaphragm span, and the diaphragm aspect ratio.

In an attempt to improve structure ductility and prevent diaphragm and structure collapse in seismic regions, metallic dissipaters as can be located adjacent to structures (e.g., at footing interfaces) have been developed to absorb seismic energy in structural and non-structural elements. These are displacement-activated supplemental damping devices that demonstrate hysteretic behavior under cyclic loading. Metallic dissipaters have proven of great benefit and provide energy dissipation during an earthquake. The use of traditional pre-formed connections, such as embedded connectors with a jumper plate between precast construction elements (e.g., precast pre-topped double tees), is still prohibited in seismic category C or higher due to its limited ductility during an earthquake. This is unfortunate as these types of connections offer fast construction and safe transfer of gravity loads and allow for good construction tolerances between the double tee units. There have been connectors developed as High Deformation Elements (HDE), which means they have tension deformation capacity greater than or equal to 0.6 in. The provisions in the building codes allow for a Reduced Design Option (RDO) for the precast diaphragm where the lowest diaphragm forces during an earthquake can be targeted. However, this code requires the connections to be HDE. Reduced diaphragm forces during an earthquake will result in reduced costs for the building (e.g., smaller or fewer walls/columns, reduced footing sizes). Metallic dissipaters can provide deformation in excess of 0.6 in. in tension or compression.

What are needed in the art are joining materials and methods suitable for use with pre-formed construction elements such as precast pre-topped concrete double tees that can provide for both strength and ductility capable of transferring seismic forces safely to the resisting systems (e.g., walls and columns). Such materials and methods could prevent catastrophic failure of a structure in natural disasters. Joining materials and methods suitable for use in forming diaphragms of such pre-formed construction elements would be particularly beneficial in the art of precast structures.

SUMMARY

According to one embodiment, disclosed is a pre-formed construction element that includes a flange and a recess defined in a first edge of the flange. The construction element also includes a connector, with at least a first portion of the connector embedded in the flange and a connection surface of the connector available for forming a connection within the recess. The construction element further includes a passive energy dissipation device, e.g., a passive hysteretic damper, that is connectable to the connection surface. Upon the connection, a portion of the passive hysteretic damper extends beyond the recess, with this portion being configured for connection to a second connection surface of an adjacent pre-formed construction element.

In one embodiment, the pre-formed construction element is a precast pre-topped concrete double tee, and in one particular embodiment, is a precast pre-topped double tee diaphragm element.

In one embodiment, the energy dissipation device can include a U-shaped flexural plate (UFP).

Also disclosed is a passive hysteretic damper that includes an UFP and a reinforcement element. More specifically, in a transverse plane through the UFP, the UFP can include a curved portion, a first straight portion extending from a first end of the curved portion, and a second straight portion extending from a second end of the curved portion. The reinforcement element has a size so as to be nested in the curved portion of the UFP. Upon this nesting, the reinforcement element defines a circle in the transverse plane. For instance, the reinforcement element can be hollow or solid and in the shape of a cylinder.

According to one embodiment, disclosed is a pre-formed construction element that includes a flange. The pre-formed construction element also includes a reinforcing bar (e.g., rebar), at least a portion of which is within the construction element, e.g., rebar. The construction element further includes a bar dissipater. The bar dissipater includes an inner bar and an outer confining tube. The inner bar includes a first end and a second end and optionally defines one or more grooves between the first and second end. The first end is connectable to an end of the internal reinforcing bar. In some embodiments, the second end is connectable to a connection surface at a surface of the flange. In some embodiments, the second end extends beyond the connection surface and is connectable to the end of a second reinforcing bar, at least a portion of which being within a second construction element. In some embodiments, the first and/or second ends are threaded ends.

Also disclosed are methods for forming a load-bearing surface, such as a diaphragm. A method can include attaching an energy dissipation device, e.g., an UFP or a bar dissipater, to a flange of a construction element. The method also includes connecting a plurality of the construction elements to one another such that the energy dissipation device is present at a joint formed between adjacent construction elements. In some embodiments, the construction elements can be connected to one another by use of a plurality of the energy dissipation devices to form a plurality of joints between two adjacent construction elements, the energy dissipation devices spanning the joints. In some embodiments, the energy dissipation device can be at least partially within the construction elements and adjacent construction elements can be attached to one another by use of previously known connectors, e.g., weld plates and erection slugs.

BRIEF DESCRIPTION OF THE FIGURES

A full and enabling disclosure of the present subject matter, including the best mode thereof to one of ordinary skill in the art, is set forth more particularly in the remainder of the specification, including reference to the accompanying figures in which.

Figure 1:
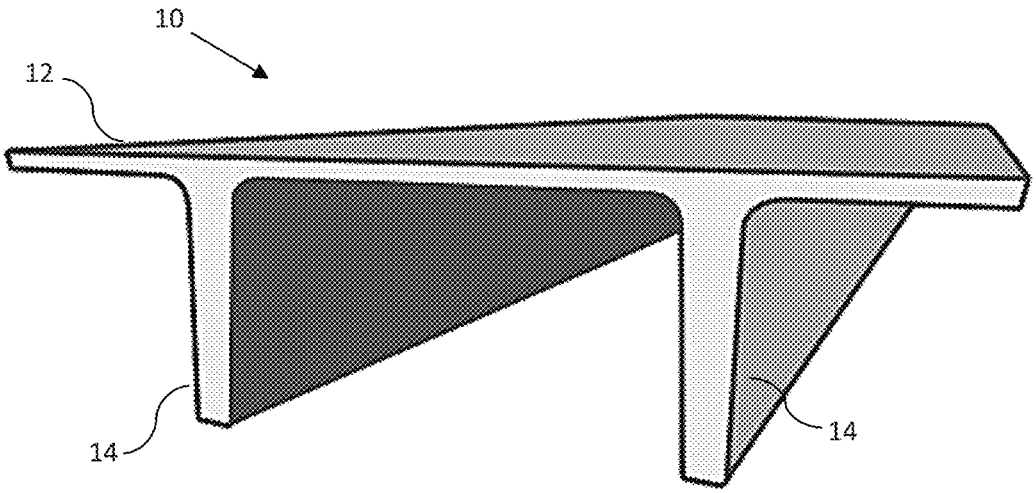
FIG. 1 Prior Art
FIG. 1 presents a perspective view of a prior art precast double tee span.
Figure 2:
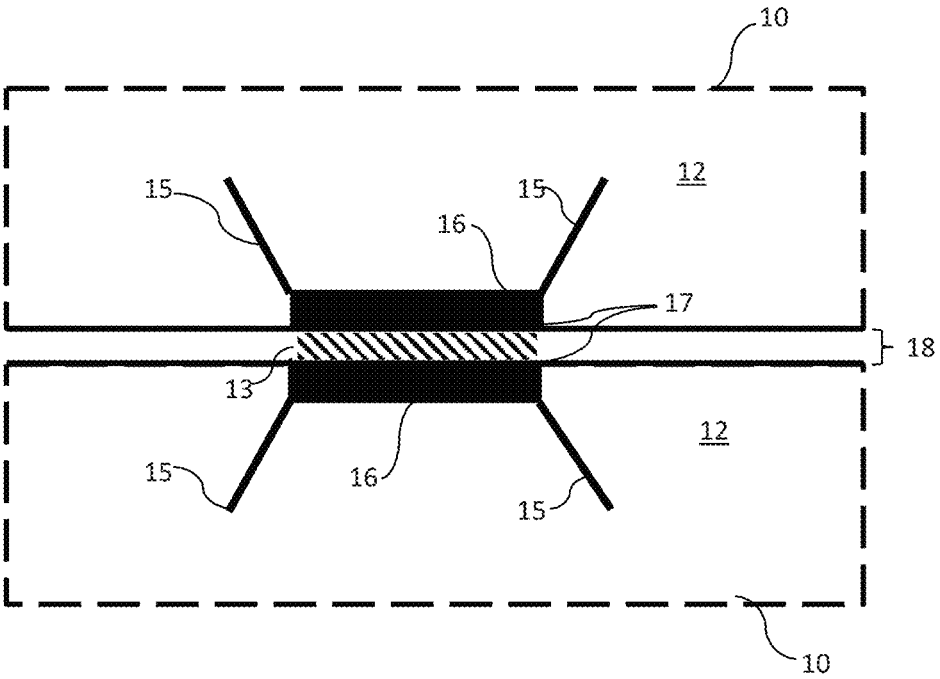
FIG. 2 Prior Art
FIG. 2 presents a plan view of a prior art connection formed between two precast double tee spans.

Repeat use of reference characters in the present specification and drawings is intended to represent the same or analogous features or elements of the present invention.

DETAILED DESCRIPTION

Reference will now be made in detail to various embodiments of the disclosed subject matter, one or more examples of which are set forth below. Each embodiment is provided by way of explanation of the subject matter, not limitation thereof. In fact, it will be apparent to those skilled in the art that various modifications and variations may be made in the present disclosure without departing from the scope or spirit of the subject matter. For instance, features illustrated or described as part of one embodiment, may be used in another embodiment to yield a still further embodiment.

In general, disclosed herein are materials and methods as may be used for joining structural elements, and in one embodiment, for joining pre-formed structural elements for use in load-bearing applications. In one particular embodiment, the materials and methods can be utilized in forming a structural diaphragm, i.e., a structural element that transmits lateral loads to the seismic force-resisting elements of the structure (such as shear walls, columns, or frames).

The joining materials and methods are particularly beneficial for use with precast, pre-topped double tee concrete spans, an example of which is illustrated in FIG. 1. However, it should be understood that the disclosure is not limited to such applications, and diaphragm elements or other pre-formed structural elements of other materials, e.g., wood, metal, synthetic materials including laminates, and the like, as may be utilized in construction applications, and particularly load-bearing construction applications such as diaphragms, can also be utilized with the joining materials and methods. As such, the term "flange" as utilized herein generally refers to a load-bearing flat surface of a pre-formed structural element, independent of the material of formation of the structural element.

Disclosed systems incorporate a passive energy dissipation device in a joint formed between pre-formed construction elements. Passive energy dissipation devices such as dampers, braces, and mechanical dissipative fuses are known devices that have been used to limit vibration and to dissipate energy by use of a passive, i.e. non-powered, mechanism. Passive energy dissipaters have been used, for instance, as bracing to provide lateral resistance against loads and have been located between adjacent vertical structural members to absorb energy through a vertical shear sliding mechanism. Many types of passive energy dissipaters are available in the market as may be incorporated in a joint formed between pre-formed construction elements as described herein. Passive energy dissipaters encompassed herein include those having a deformation capacity of from 0.6" up to any amount desired (e.g., ductile connection). Examples of energy dissipaters as may be utilized include, without limitation, dampers (e.g., metallic dampers and viscous fluid dampers) and mechanical buckling restrained braces (BRBs).

Dampers are a particular type of energy dissipaters that dissipate the kinetic energy swept into them by relative motion of movable ends of the device. Dampers function by exerting a force upon their movable ends that opposes the relative displacement of the ends due to an applied force. In hysteretic dampers, this opposing force is achieved by the hysteretic behavior of the material that forms the damper, traditionally steel. Beneficially, hysteretic dampers can absorb a substantial portion of input energy through hysteretic deformation of the damper material. A number of hysteretic dampers with high energy dissipation capacity have been developed and may be utilized in disclosed systems. Passive hysteretic dampers as may be incorporated in a joint formed with a pre-formed construction element can include, without limitation, added damping and stiffness (ADAS) devices (e.g., triangular plate ADAS (TADAS), rhombic ADAS, X-steel plate ADAS (XADAS), etc.); honeycomb dampers; dual-function metallic dampers (DFMD); slit dampers; buckling restrained braces; tube-in-tube dampers; circular plate dampers; crescent moon shaped elements; tapered pin energy dissipating elements; C-clamp type elements; and butterfly-shaped dampers.

Figure 3:
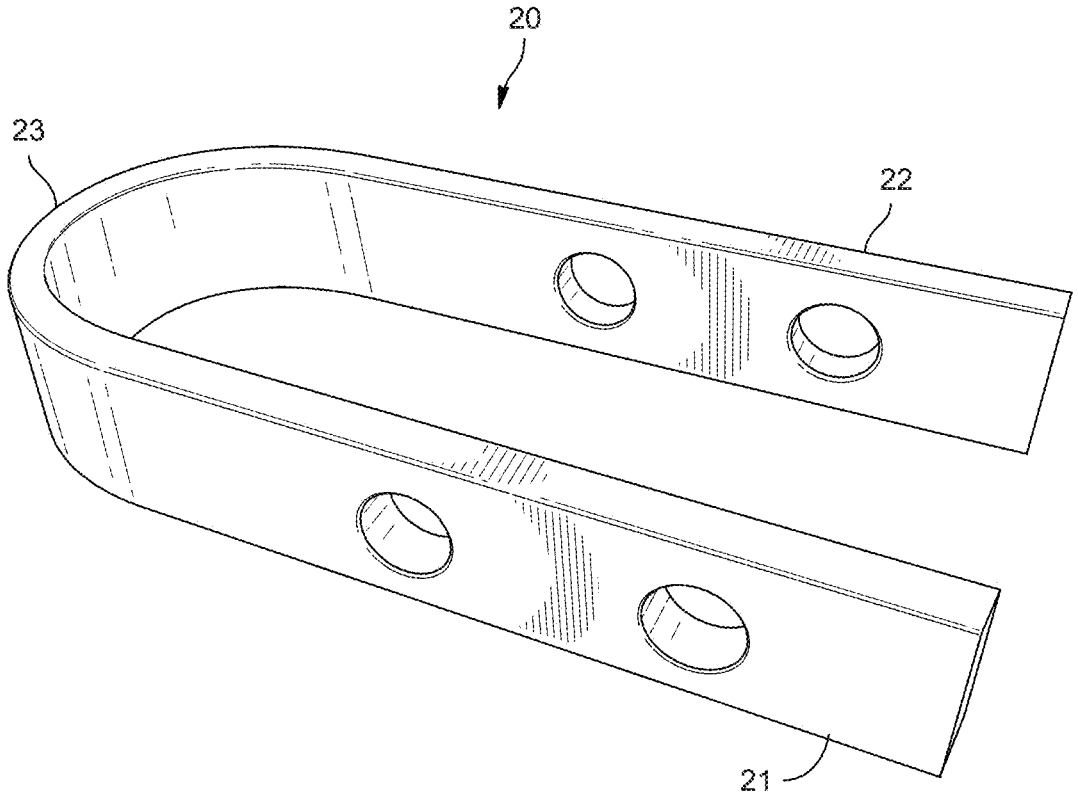
FIG. 3 presents a perspective view of a U-shaped flexural plate (UFP).

In one embodiment, a joint can incorporate a U-shaped flexural plate (UFP), an example of which is illustrated in FIG. 3. UFPs are a type of passive hysteretic damper developed in the 1970s in New Zealand. As shown in FIG. 3, an UFP 20 can include two straight leg portions 21, 22 that extend from either end of a curved portion 23. They are traditionally formed of mild steel plates and are mounted between wall panels in seismic areas, including timber rocking walls and concrete rocking walls.

Figure 4:
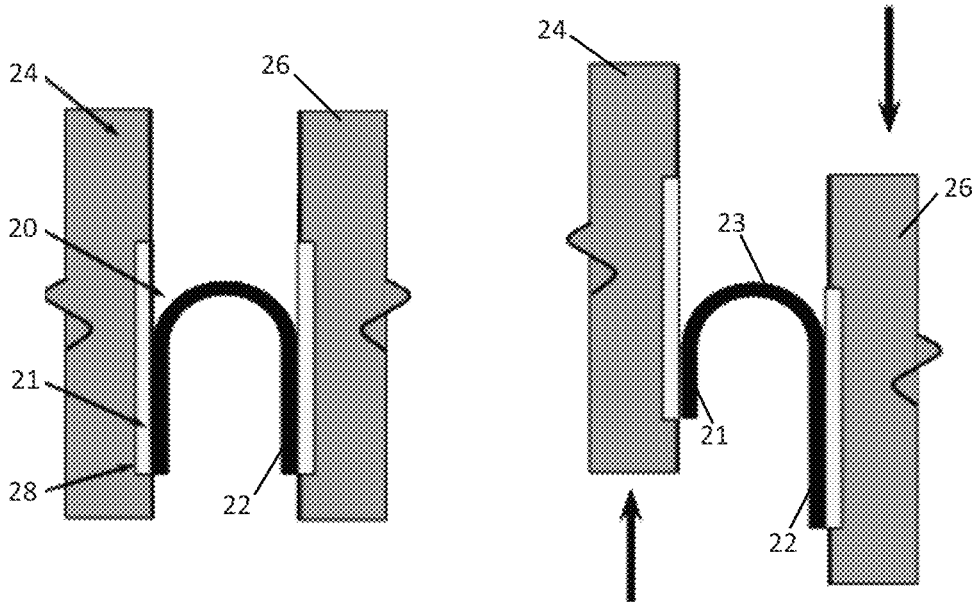
FIG. 4 illustrates the utilization of an UFP to join vertical walls and the UFP working mechanism.

The working mechanism for an UFP located between vertical walls is illustrated in FIG. 4. As shown, an UFP 20 can be mounted between adjacent wall panels 24, 26 by attachment of the legs 21, 22 to each structure 24, 26, respectively. Attachment can be by welding to an embedded steel plate 28 or any other suitable attachment mechanism. Upon application of a shear force, the structures 24, 26 can be subjected to relative motion, as indicated by the directional arrows on the right panel of FIG. 4. As indicated, the legs 21, 22 of the attached UFP will likewise undergo a relative motion. This movement yields the UFP over the curved portion 23, and thereby provides energy dissipation, which can reduce damage to the supporting structures 24, 26.

UFPs can be a beneficial choice as a passive hysteretic damper for use in one embodiment of disclosed systems as they offer simple fabrication, high strength, excellent fatigue resistance, simple installation, and replicability, if needed. While much of this disclosure is directed to utilization of UFPs and UFP-based dampers, it should be understood, however, that any suitable energy dissipation device, including any suitable passive hysteretic damper, can be utilized as described.

A passive hysteretic damper can be formed of any suitable hysteretic material and to any suitable size. By way of example, a passive hysteretic damper can be formed of a steel (e.g., a mild steel), aluminum, a titanium alloy ($Ti_6AL_4V$), stainless steel, or any other suitable metal. In one embodiment, a passive hysteretic damper can be formed of a shape memory alloy. Shape memory alloys belong to a class of shape memory materials that have the ability to 'memorize' or retain their previous form when subjected to certain stimulus, such as temperature, mechanical stresses, or magnetic fields. Shape memory alloys can exhibit either a one-way effect, in which case a material can hold a deformed shape until subjected to a stimulus, e.g., heat, upon which the material will return to the original shape; or they can exhibit a two-way effect, in which case the material can hold a first deformed shape at a first condition (e.g., low temperature), and can hold a second deformed shape at a second condition (e.g., high temperature). Shape memory alloy materials can also display superelasticity, in which case the material can display large, recoverable strains upon an applied stress with little or no permanent deformation. Examples of shape memory alloy materials as may be incorporated in an UFP can include, without limitation, nickel alloys including nickel-titanium alloys (e.g., Ni—Ti, Ni—Ti—Hf, Ni—Ti—Pd) and other nickel alloys (e.g., Ni—Mn—Ga, Ni—Fe—Ga, Co—Ni—Ga, Co—Ni—Al); copper-based alloys (e.g., Cu—Al—Ni, Cu—Al—Ni—Hf, Cu—Sn, Cu—Zn, Cu—Zn—Si, Cu—Zn—Al, Cu—Zn—Sn); and iron-based alloys (e.g., Fe—Mn—Si), just to name a few.

Figure 5:
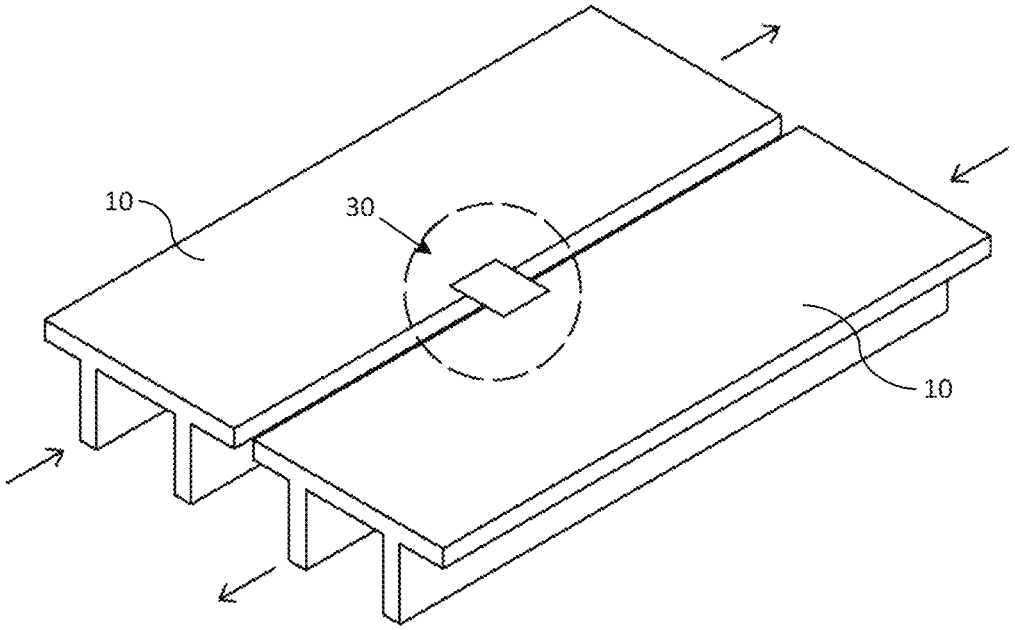
FIG. 5 illustrates a flange-to-flange connection location between precast double tees as described herein.

FIG. 5 illustrates a typical connection site 30 as may be located between two precast, pre-topped concrete double tees 10 according to presently disclosed systems. As indicated, the connection 30 can allow for movement between the double tees, as indicated by the directional arrows. As indicated previously, the connection site 30 is equally applicable to pre-formed material panels made of steel, timber, or other materials, and it can be applied to any load-bearing flange surface, including horizontal or inclined diaphragm elements, platforms, floors, parking garages, etc.

Figure 6:
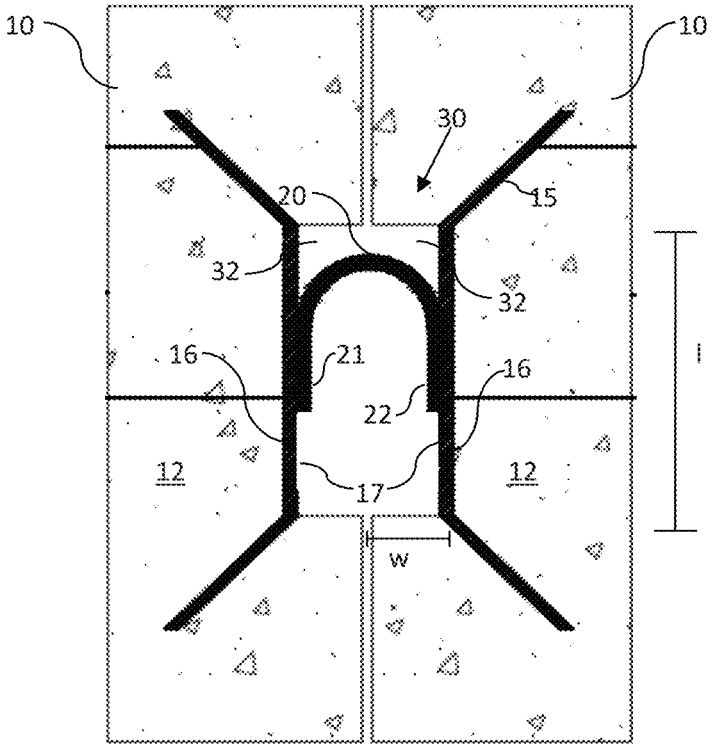
FIG. 6 illustrates a joint in a recess as described herein that incorporates a single UFP for shear reinforcement between two double tees.

FIG. 6 illustrates a closer view of one embodiment of a connection site 30 between two double tees 10 that includes a single UFP 20. In this particular embodiment, the single UFP can provide additional shear reinforcement to a diaphragm. However, and as discussed and illustrated in more detail herein, an UFP can additionally provide chord reinforcement to a diaphragm. As shown, each double tee 10 defines a recess 32 within a flange 12 of the double tee. A recess 32 can be of a suitable length, width, and depth so as to contain a portion of an energy dissipation device, e.g., a portion of an UFP 20. For instance, a recess 32 can have a width (w) equal to about half of the total width of the UFP, e.g., from about 1 inch to about 4 inches, depending on the preferred size and capacity of the energy dissipation device to be used. A recess 32 can generally have a length (l) of from about 6 inches to about 24 inches, though this also can vary depending upon the preferred size/stroke and number of the energy dissipation devices to be located within the recess 32. In one embodiment, the recess 32 can have a depth equal to that of the flange and thus can pass through the entire depth of the flange 12, i.e., the recess 32 can be open at the top and bottom of the flange 12. In other embodiments, the recess can be covered at the top and/or bottom side of the flange 12. For instance, a recess 32 can be covered on one or both sides with a thin plate of the same or different material as the formation material of the flange following formation of the joint.

As indicated, each double tee 10 can include a pre-formed connector 16 that is cast into the flange 12 at the time of formation including internal portions 15 and a connection surface 17 that is available for forming a connection with another component within the recess 32. Any suitable connector 16 can be incorporated in the double tee including, without limitation, hairpin connectors, stud-welded deformed bar anchors, bent wings, mesh connectors, angle connectors, structural tees, bent plate connectors, and vector connectors.

To form the joint, one leg 21 of the UFP 20 can be connected to a connection surface 17 of a connector 16 of a first double tee 10 and the other leg 22 of the UFP 20 can be connected to a connection surface 17 of a connector 16 of a second, facing double tee 10. Connection can be via welding, bolting, etc. with a preferred connection generally depending upon the materials of construction.

Upon subjection of the joined double tees to shear forces, e.g., during a seismic event, the shear forces developed longitudinally can activate the UFP in a sliding motion similar to that of vertical walls, as illustrated in FIG. 4. This can dissipate energy at the joint, e.g., at the diaphragm level, before such forces are transferred to other portions of the structure, such as the walls, columns, etc. In the particular embodiment of a dissipative precast diaphragm floor, this can increase the natural period of the building, thus reducing the seismic forces on the walls, columns, etc. of the building. This can result in smaller demands on the structural elements of the building, which can reduce damage to the structural elements due to the shear forces. Moreover, an UFP-containing joint can also provide transverse continuity for shear and/or tension forces under gravity loads. The UFP can also allow for expansion/contraction of the joints due to other forces, e.g., a change in temperature. As the use of pre-formed structural elements can also provide cost savings during construction, the disclosed materials and methods can provide multiple benefits in both cost and safety.

Figure 7:
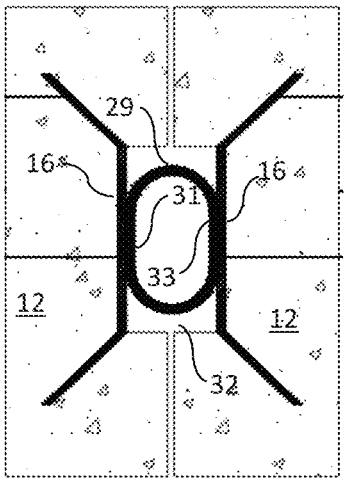
FIG. 7 illustrates a joint as described herein that incorporates a double UFP.

A joint can include any suitable form of an UFP energy dissipation devices. For instance, as illustrated in FIG. 7, a joint can include an UFP in the form of a double UFP 29, which is formed of two UFPs that can be separated or joined to one another at their ends or a single plate folded into a double UFP, as desired. The sides 31, 33 of the double UFP 29 can be attached to adjacent flanges 12 and held within a single recess 32 via the respective connectors 16.

Figure 8A:
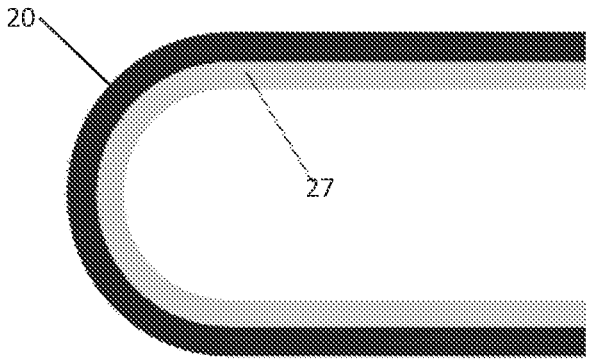
FIG. 8A illustrates a single-nested UFP as may be incorporated in a joint.
Figure 8B:
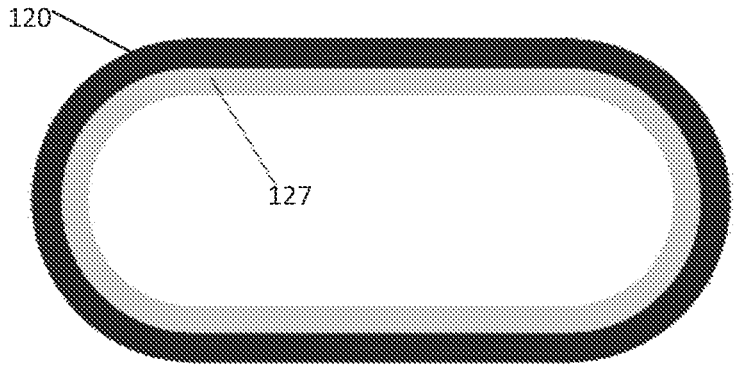
FIG. 8B illustrates a double-nested UFP as may be incorporated in a joint.

In another embodiment, illustrated in FIG. 8A and FIG. 8B, two (or more) single UFPs 20, 27 (FIG. 8A) or double UFPs 120, 127 (FIG. 8B) can be nested inside one another. The maximum strain in an UFP is a function of thickness of the plate and radius of curvature of the curved portion of the plate, and a smaller radius can make the UFP more susceptible to low-cycle fatigue failure. To help prevent this situation, two UFPs can be nested within one another as indicated in FIG. 8A and FIG. 8B. Moreover, nested UFPs can be in the form of single nested UFP, as illustrated in FIG. 8A, or in the form of a double nested UFP including two nested double UFPs 120, 127, as illustrated in FIG. 8B. Nested UFP can generally be tied to one another using, e.g., welding or bolting, or they can be left unattached to each other.

Figure 9:
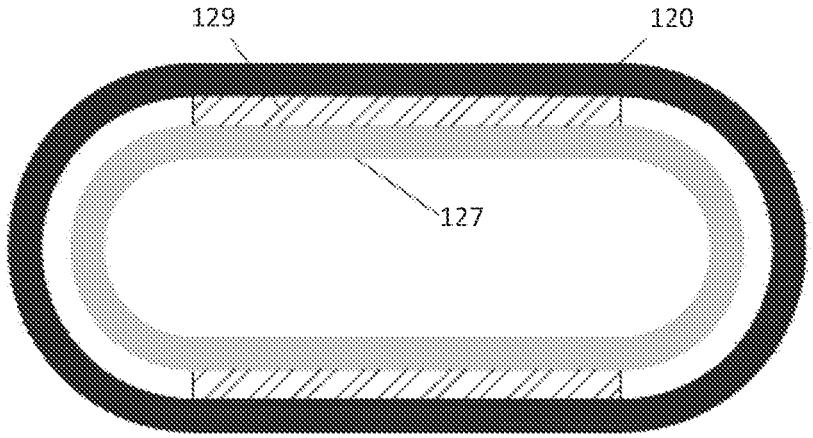
FIG. 9 illustrates a reinforced nested double UFP as may be incorporated in a joint.

A nested UFP can also include a reinforcement between the two UFPs. For instance, as indicated in FIG. 9, a plate 129 can be located between the nested double UFPs 120, 127. Plate 29 can be, for instance, a metal plate such as a steel plate (e.g., a mild steel) that can reinforce the UFP and also provide a connection between the two.

Figure 10:
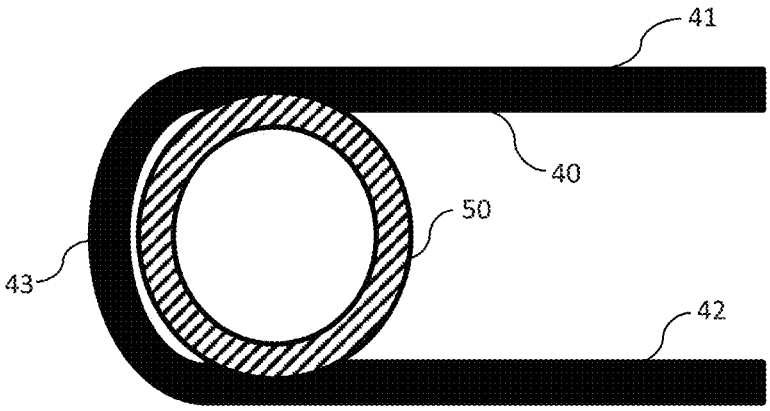
FIG. 10 illustrates a reinforced UFP as may be incorporated in a joint.

FIG. 10 illustrates another embodiment of a passive hysteretic damper as may be utilized in disclosed systems, as well as in other applications. As illustrated, the passive hysteretic damper includes an UFP 40, which is visualized in a transverse plane in FIG. 10. The UFP can be an UFP as is known in the art and can include a curved portion 43, as well as a first straight portion 41 and a second straight portion 42 contiguous with either end of the curved portion 43. In addition, the UFP can be formed of any suitable material, can be a nested UFP, and can be a single or a double UFP, as previously discussed.

In conjunction with the UFP 40, the passive hysteretic damper can include a reinforcement element 50. As shown, the reinforcement element 50 can describe a circle in the transverse plane of the UFP. The reinforcement element 50 can provide additional capability of the damper to oppose and dissipate compression forces upon the damper. In addition, the reinforcement element 50 can provide a guide around which the UFP can move during use. As such, the addition of the circular reinforcement element 50 to the damper can improve response of the damper to both shear and flexural forces.

Figure 11:
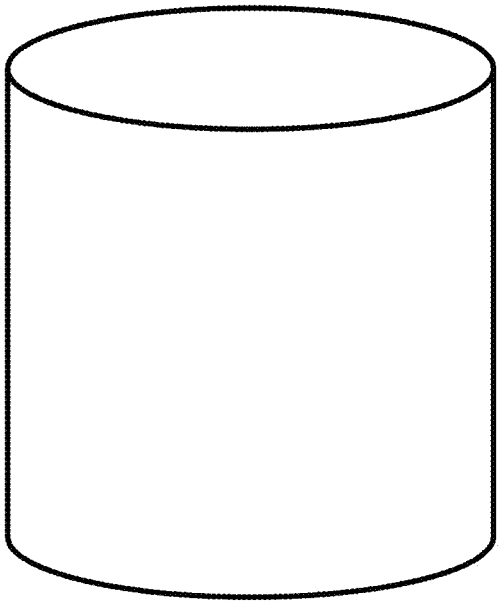
FIG. 11 illustrates an exemplary shape for a reinforcement element of a passive hysteretic damper as described herein.

The three-dimensional shape of the reinforcement element 50 can be any shape that can provide a circular plane for reinforcement of the curved portion 43 of an UFP. For instance, as illustrated in FIG. 11, a reinforcement element can be in the shape of a cylinder. In addition, a reinforcement element can be solid or hollow, as desired, and can be open or closed at one or both ends.

In one embodiment, a reinforcement element 50 can be formed of the same material as an UFP with which it is associated, but this is not a requirement of a system.

The reinforcement element 50 can be attached to the UFP in any suitable fashion including, without limitation, welding, bolting, etc.

Figure 12:
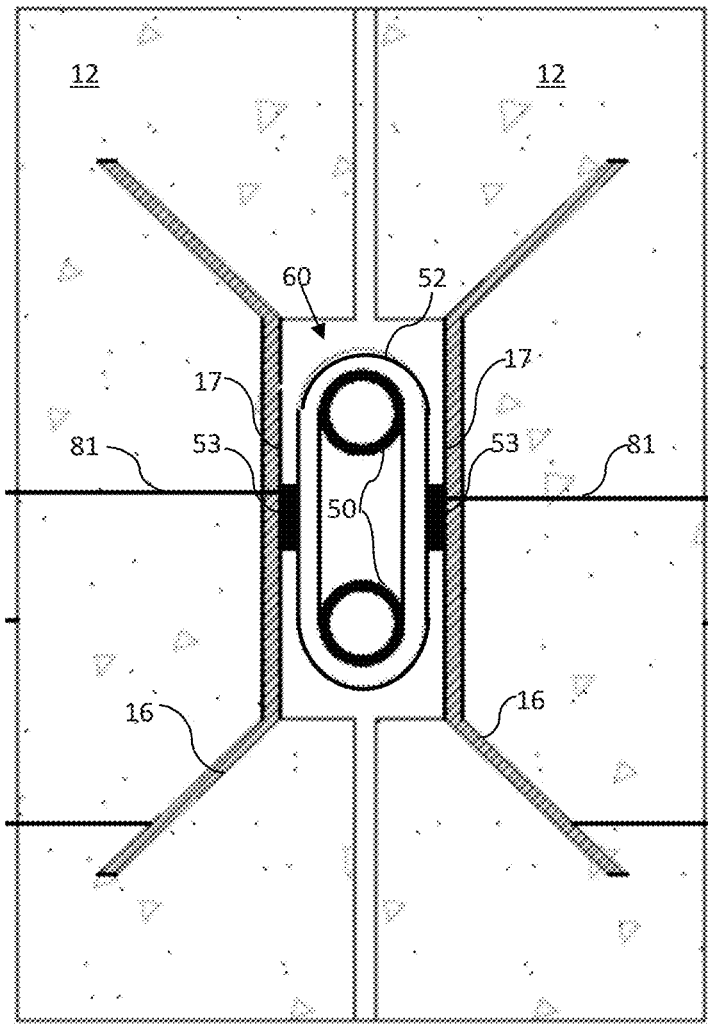
FIG. 12 illustrates a joint as described herein that incorporates a double, reinforced UFP for chord reinforcement between two double tees.

FIG. 12 illustrates a joint formed between two flanges 12 by use of a passive hysteretic damper 60. As illustrated, the passive hysteretic damper 60 includes a double UFP 52, with each curved portion of the double UFP 52 being associated with a reinforcement element 50 nested in the curved portions of the UFP 52. Each of the two flanges 12 include a recess within which the passive hysteretic damper 60 is held. Specifically, the UFP legs can be connected via a weld 53 or the like to the connection surfaces 17 of the respective connectors 16 to provide a strong but ductile joint between two precast structural elements as chord elements. In the embodiment of FIG. 12, the joint can also include connection between reinforcing bars (e.g., rebar 81) embedded within the flanges 12 and the hysteretic damper 60. For instance, the reinforcement rebar 81 of adjoining flanges 12 can be connected (e.g., welded) to the connectors 16, which are then connected to the hysteretic damper 60. As such, the hysteretic damper can provide additional chord reinforcement in conjunction with shear reinforcement for the structure. As discussed previously, in other embodiments, the UFPs can be utilized without the reinforcement elements 50, and thus, the UFPs can exhibit increased tension/compression loading (e.g., motion of the UFP legs toward and away from each other) as compared to when used with a reinforcement element 50 between the UFP legs.

In one embodiment, a system can incorporate a bar dissipater as a passive energy dissipation device for flange connections. Bar dissipaters are mini plug-and-play devices that can be used to dissipate seismic energy at a flange joint through axial deformation and can offer advantages in disclosed systems such as, and without limitation to, easy fabrication, lower cost, higher strength, good ductility, and compactness. They can be formed of any suitable material including, without limitation, mild steel, stainless steel, aluminum and alloys thereof, titanium alloys, shape memory alloys, and other metals and alloys as known in the art.

Figure 14:
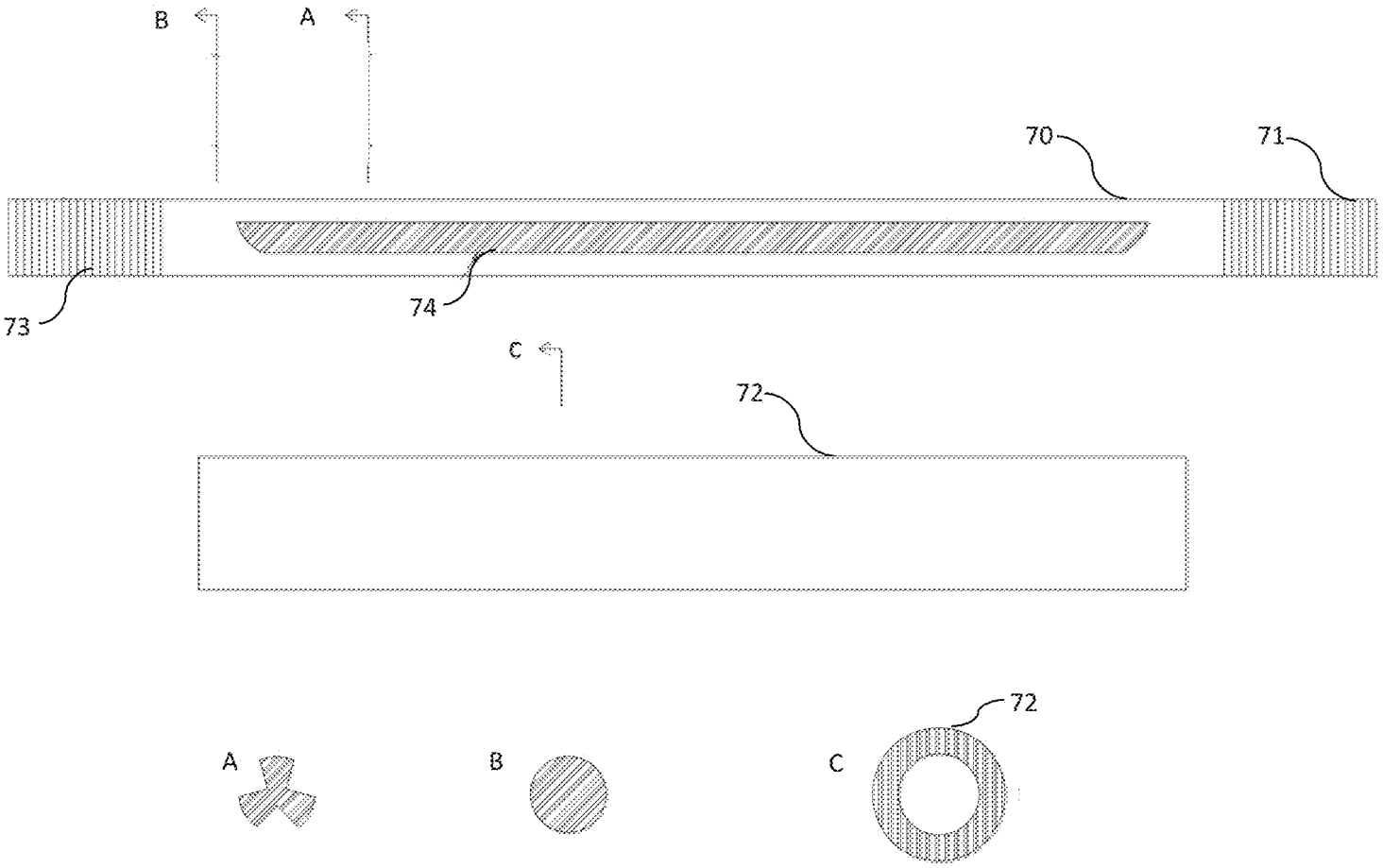
FIG. 14 illustrates one embodiment of a bar dissipater as may be utilized as described herein.

In general, a bar dissipater, one embodiment of which is illustrated in FIG. 14, includes a bar 70 that during use is retained within an outer confining hollow tube 72. The bar 70 can include one or more grooves 74 (machined part) made between ends 71, 73 of the bar 70. In some embodiments, the ends 71, 73 can be threaded. Alternatively, the ends can be solid (i.e., non-machined) or otherwise machined and configured for a particular type of connection. The grooves 74 can allow for additional yielding to occur under applied force. As shown at A and B, the bar 70 can have a generally circular cross-section at one or more portions of the axial length, and as shown at A, can have a non-circular cross-section in the machined areas (e.g., at the groove locations), which can vary depending upon the shape, number, and location of the grooves. Upon location of the bar 70 within the hollow tube 72, there can be a small gap (generally about 1 mm or less, e.g., about 0.5 mm to about 1 mm) between the largest diameter of the bar 70 and the inner wall of the tube 72. The overall cross-sectional dimensions of a bar dissipater can vary, generally depending upon the particular application of the devices. For instance, a bar 70 can have a diameter in the circular, non-machined sections of from about 10 mm to about 30 mm; for instance, from about 16 mm to about 25 mm in some embodiments.

Figure 13:
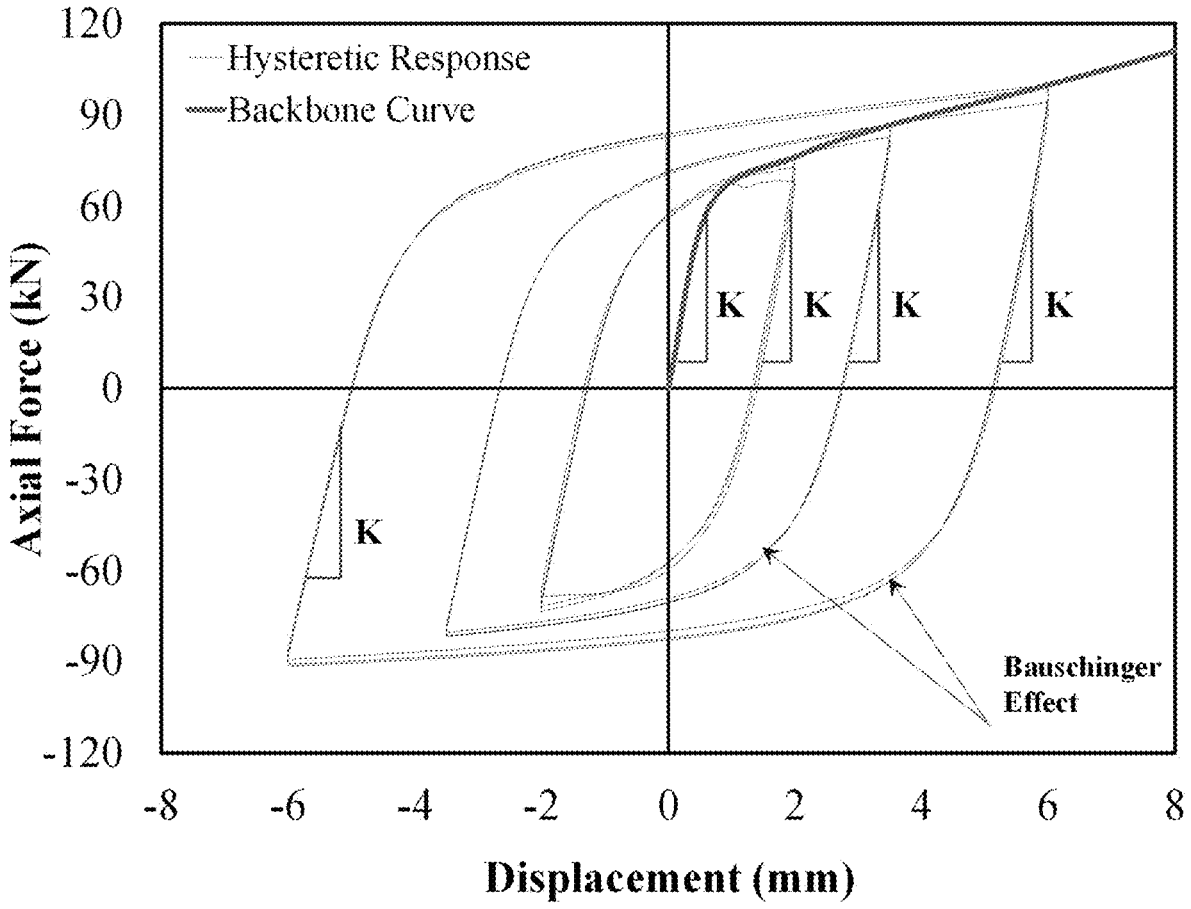
FIG. 13 provides a typical response of a bar dissipater under cyclic axial tension and compression loading.

When a bar dissipater is in tension or compression, it can yield from machined region(s), and the outer confining tube prevents buckling of the dissipater under compression. A typical response of a bar dissipater under cyclic axial tension and compression loading is provided in FIG. 13.

Figure 15:
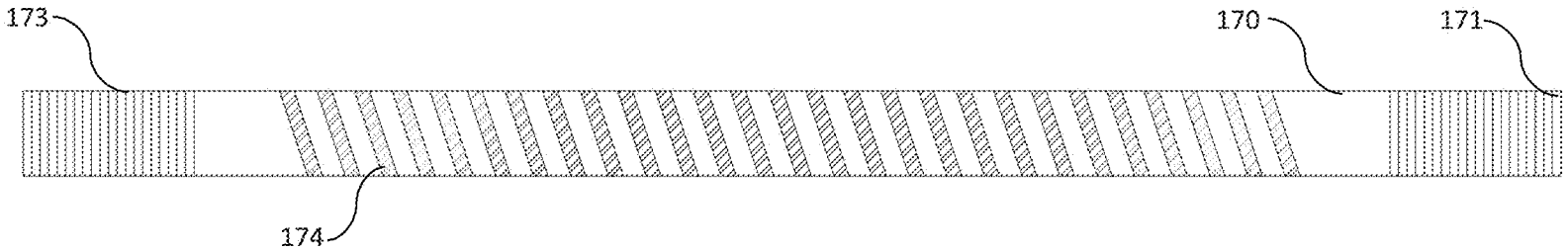
FIG. 15 illustrates one embodiment of an inner bar of a bar dissipater as may be utilized as described herein.
Figure 16:
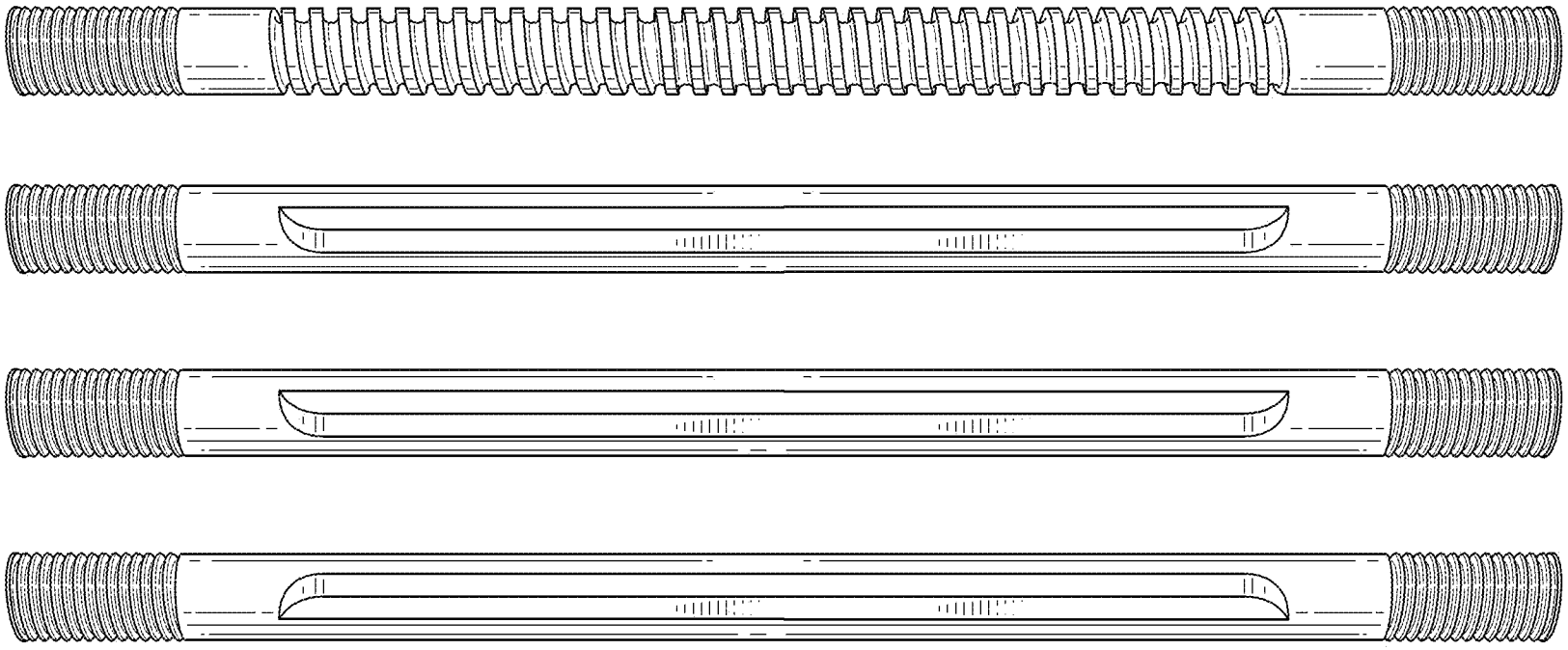
FIG. 16 illustrates several examples of inner bars of bar dissipaters made of different materials as may be utilized as described herein.

The groove pattern of a bar dissipater as may be utilized as described herein is not particularly limited. By way of example and without limitation, FIG. 14, FIG. 15, and FIG. 16 include several different embodiments of bar dissipaters including different groove patterns and that can be formed of different materials. As schematically illustrated in FIG. 15 and pictured in FIG. 16, in one embodiment, a bar 170 of a bar dissipater can include a single spiral groove 174 between the ends 171, 173. As illustrated in FIG. 16, other groove patterns can vary with regard to shape, size, and number of individual grooves formed on the bar. Moreover, bar dissipaters for use as described herein can be formed of any suitable material including, without limitation, steel (e.g., mild steel), stainless steel, aluminum alloys, titanium alloys, shape-memory alloy, etc., as well as combinations of materials.

In some embodiments, machined areas of a bar dissipater can be filled with a filler material, such as, and without limitation to, epoxy, concrete, grout, etc., which can prevent or reduce snake-shape buckling of the bar under cyclic loading and can enhance the overall force-displacement hysteretic response characteristic of the dissipater.

In one embodiment, bar dissipaters can be used to absorb seismic and other energy as chord connection for the flange-to-flange connection of untopped (pre-topped) double tee diaphragm in seismic regions. For instance, one or more bar dissipaters can be installed in conjunction with a flange joint and provide reinforcement in each flange of the joint as a "dry" chord to resist tension and compression loading during a cyclic motion such as an earthquake.

Figure 17:
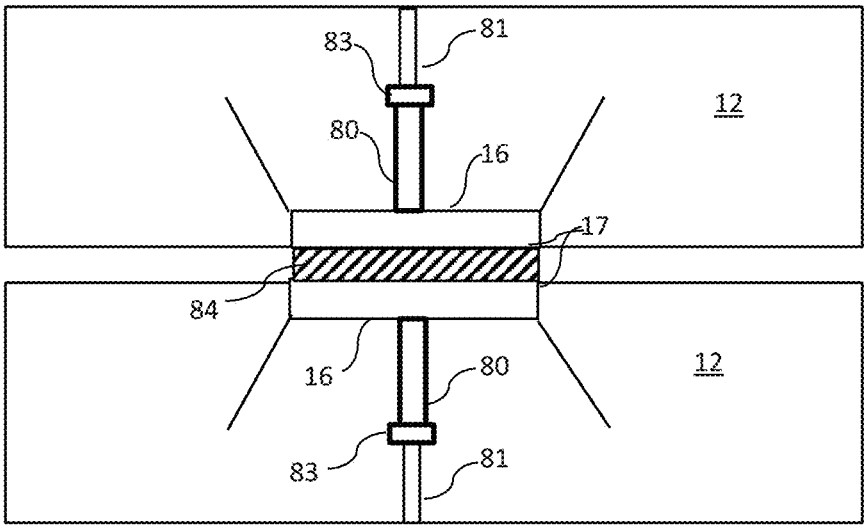
FIG. 17 illustrates one embodiment of an installation of a bar dissipater for chord reinforcement as described herein.

As illustrated in FIG. 17, in one embodiment, two flanges 12, each of which including reinforcing bars, e.g., a rebar 81, as is generally known in the art, precast within the flanges, can be located adjacent to one another for forming a joint 84 there between. In formation of a joint 84, a bar dissipater 80 can be located between the end of a rebar 81 and a connector 16 in each of the two flanges 12. For instance, the end portion of a rebar 81 can be threaded for attachment to a coupler 83 or can be simply welded to a coupler 83. The coupler 83 can include internal threading configured for attachment to a threaded end of a bar of a bar dissipater 80, can be welded to the end of a bar dissipater 80, or can be attached in any suitable fashion. The second and opposite end of the bar dissipater 80 can be attached via the second end of the bar dissipater 80 to connector 16 via, e.g., welding, threaded attachments, etc. The adjacent connectors 16 of the two flanges 12 can then be joined to one another to form a joint 84 according to standard practice, generally depending upon the particular type of connectors 16, flanges 12, materials of formation, etc. The bar dissipater 80 can thus be a HDE (e.g., tension deformation of 0.6 inches or more) and a ductile link. For example, in the embodiment illustrated in FIG. 17, the connectors 16 can be joined between the two flanges 12 to form a welded chord connection joint 84, as is generally known in the art, between the connection surfaces 17 of the connectors 16.

Beneficially, in some embodiments, the bar dissipaters 80 can be detailed to be replaceable. For instance, following a seismic event, any damaged bar dissipaters 80 of a structure can be simply removed and replaced.

Figure 18:
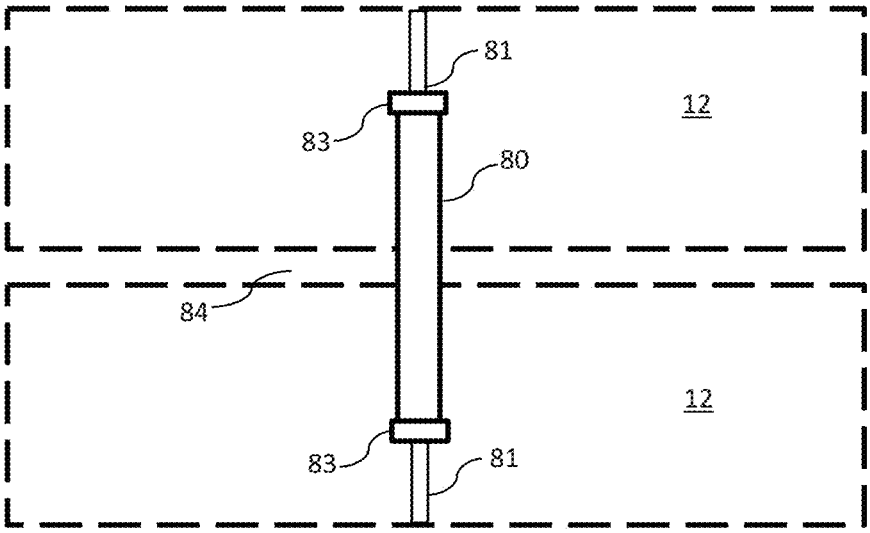
FIG. 18 illustrates another embodiment of an installation of a bar dissipater for chord reinforcement as described herein.

FIG. 18 schematically illustrates another joining mechanism between two flanges 12. As indicated, in this embodiment, a single bar dissipater 80 can span a joint 84 with the respective ends of the bar dissipater 80 attached to rebar 81 of the respective flanges 12 via couplers 83. As illustrated in FIG. 18, a joint 84 can be free of any welds, erection slugs, or reinforcing plates, and the bar dissipater 80 can be the sole joining structure of the joint 84. However, in other embodiments, a joint 84 that includes a bar dissipater 80 spanning the joint 84 and connected to rebar 81 of opposing flanges 12 can include additional joining components as are known in the art, e.g., welds, erection slugs, spacers, etc.

Figure 19:
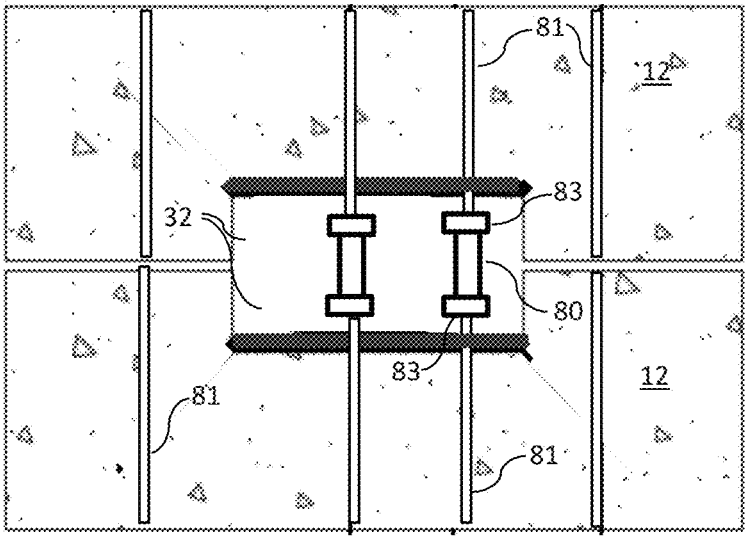
FIG. 19 illustrates another embodiment of an installation of multiple bar dissipaters in a single joint as described herein.

Another embodiment of a joint formed between two flanges 12 is illustrated in FIG. 19. As indicated, each flange 12 can include a series of rebar 81 within the flanges, as is known in the art. In addition, each flange 12 can define a recess 32 with one or more sections of rebar 81 extending into the recess 32. Within each recess 32, the end of a first rebar 81 can be coupled to a first end of a bar dissipater 80, and the second opposite end of the bar dissipater 80 can be coupled to an end of a second rebar 81 that is in the opposite flange 12. As described previously, the couplers 83 can couple the respective rebar 81 and dissipaters 80 via threading and/or welding and/or any other suitable joining mechanism. While illustrated as joining adjacent flanges 12 with two bar dissipaters within abutting recesses 32, it will be understood that one or any number of bar dissipaters can be utilized to join adjacent flanges. For instance, a single joint as defined by two adjacent abutting recesses 32 can include one, two, three, four, or more bar dissipaters 80 that are each joined to at least one rebar 81 of a flange 12.

Figure 20:
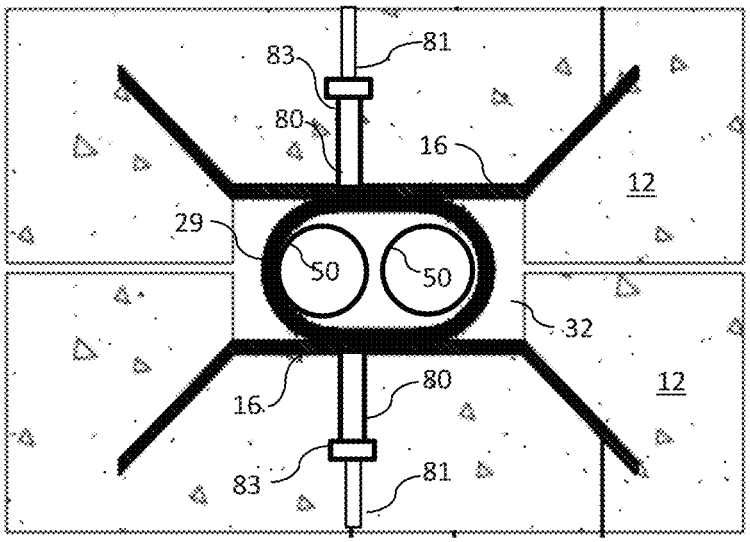
FIG. 20 illustrates an embodiment of an installation of multiple different energy dissipater types in a single joint as described herein.

In one embodiment, a joint formed between two adjacent flanges can include multiple energy dissipation devices. For example, and as indicated in FIG. 20, in one embodiment, a system can incorporate multiple bar dissipaters 80 coupled to rebar 81 at a first end and joined to a connector 16 at a second end. In addition, the system can include a double UFP 29 attached to each connector 16 and within the abutting recesses 32, as described previously. A bar dissipater can be combined with any other suitable energy dissipation device, e.g., a double UFP, a single UFP, a nested UFP, or any other energy dissipation device. For instance, in the embodiment of FIG. 20, a double UFP 29 including a reinforcement element 50 is utilized as a hysteretic damper within the joint and combined with multiple bar dissipaters 80 between rebar 81 and connectors 16.

Figure 21:
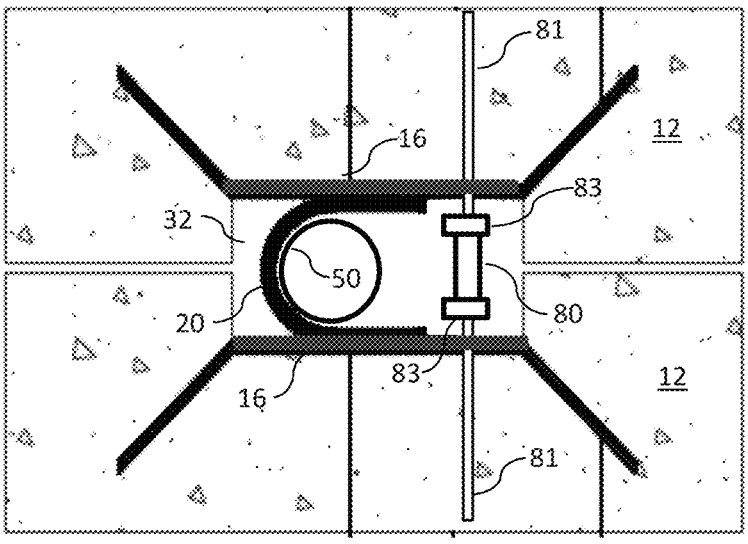
FIG. 21 illustrates another embodiment of an installation of multiple different energy dissipaters in a single joint as described herein.

FIG. 21 illustrates another embodiment of a joint formed between two flanges 12 that can include a bar dissipater 80 coupled via couplers 83 to ends of two rebar 81 of adjacent flanges 12 within abutting recesses 32. In addition, the joint includes an UFP 20 combined with a reinforcement element 50. The UFP 20 is also attached to each of two connectors 16 of the adjacent flanges 12, as described previously. Such joints, which combine multiple different types of passive energy dissipaters can provide multiple levels of response to both flexure (e.g., tension and/or compression) and shear (sliding) forces imparted upon a structure. For instance, UFP can be detailed to resist the sliding shear forces between double tees (e.g., used as web connectors), while the bar dissipaters can work as "dry" chord to absorb the tension/compression forces.

Figure 22:
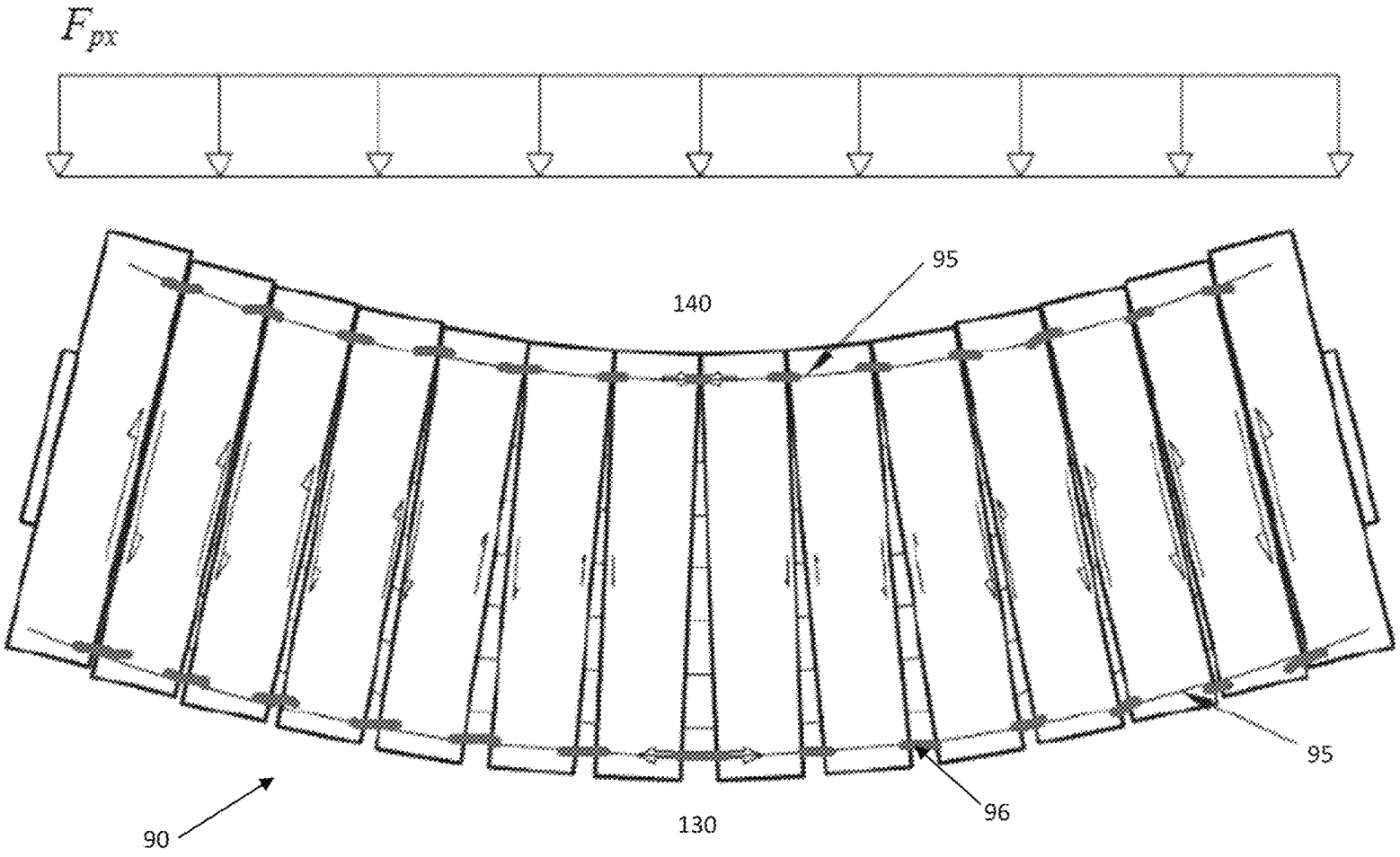
FIG. 22 illustrates tension and compression on chord connections of a diaphragm.

Connections formed between pre-formed construction elements as described can be particularly useful in diaphragms. For instance, FIG. 22 illustrates the analogy of tension 130/compression 140 in a precast diaphragm 90 during an earthquake with emphasis of chords 95 and chord connections 96. The use of dissipaters as described herein can considerably reduce the diaphragm forces as they can provide a higher response modification factor/ductility. The inclusion of energy dissipaters as described can also reduce the total forces transferred to seismic force-resisting systems and can reduce the section of the walls/columns, as well as size of the footing. Beneficially, using dissipative cry chord connections as disclosed can eliminate the need for cast-in-place topping. The precast diaphragm itself can be a dissipative element and can absorb shear and tension 130/compression 140 forces during an earthquake.

Figure 23:
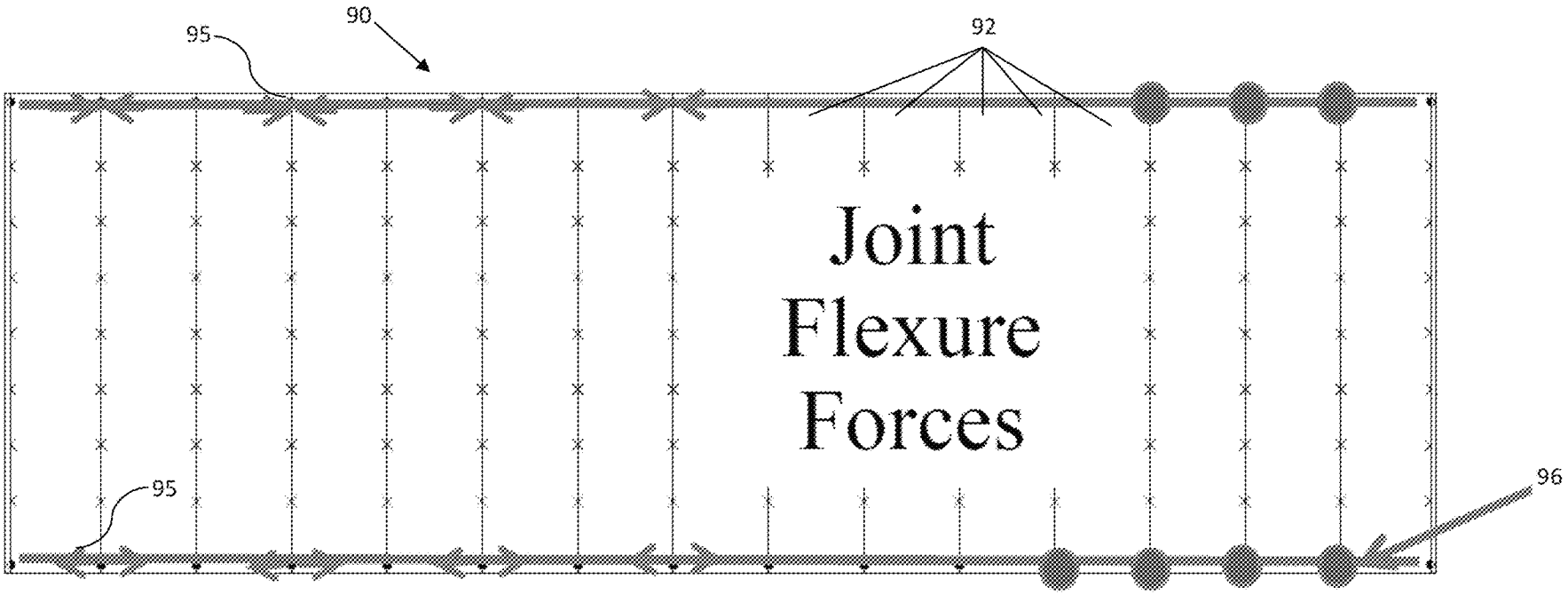
FIG. 23 illustrates a diaphragm as disclosed herein including illustration of joint flexure force designations.

FIG. 23 illustrates a diaphragm 90 formed of a plurality of pre-formed construction elements 92, e.g., precast pre-topped double tees. As indicated, the diaphragm 90 can include chords 95 extending from one end of the diaphragm 90 to the opposite end. Chord connections 96 can include energy dissipation devices and systems, as described herein. The chord connections 96 and chords 95 formed therewith can not only provide mutual support to gravity loads typical of standard chord connections but can also improve response to flexural forces and dissipate tension and compression forces due to natural forces including seismic activity. Though illustrated with only a small number of chord connections 96 that incorporate one or more energy dissipation devices at each connection location, some or all chord connections of a diaphragm can incorporate energy dissipation devices for improved response to flexure forces.

Figure 24:
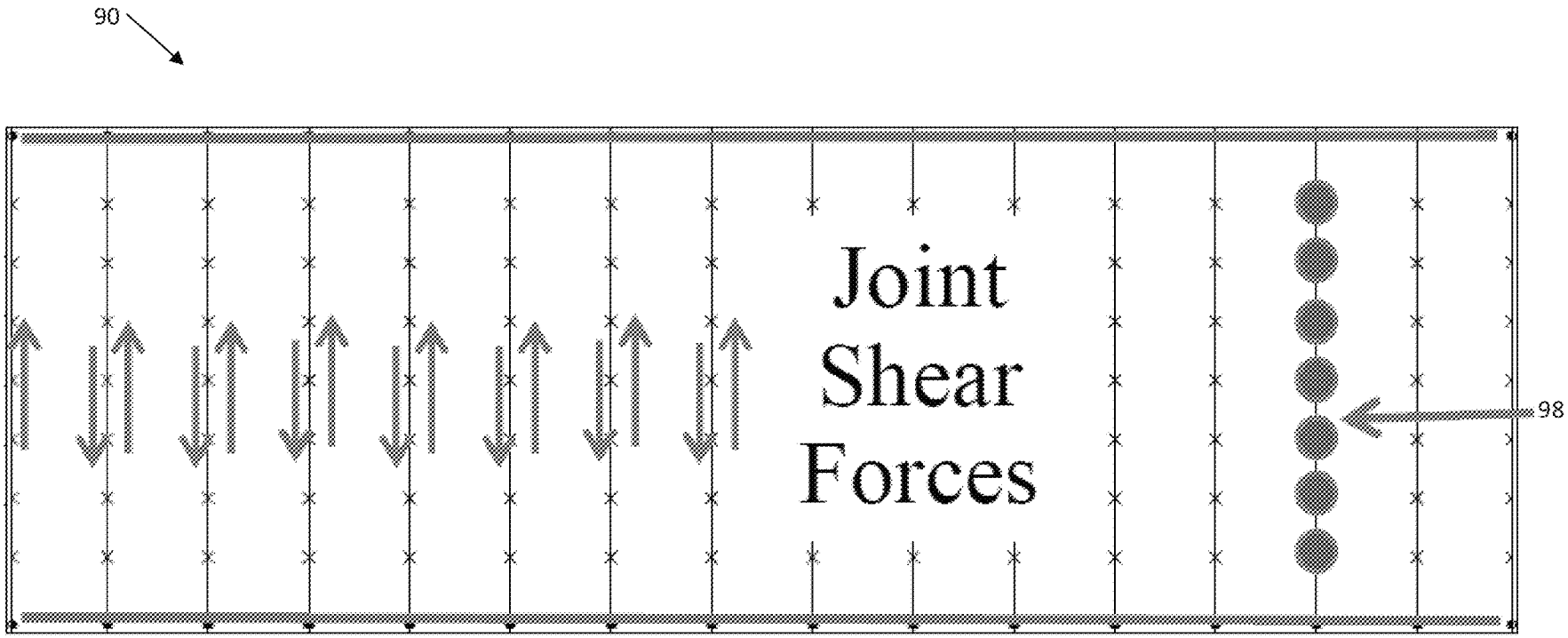
FIG. 24 illustrates a diaphragm as disclosed herein including illustration of joint shear force designations.

FIG. 24 illustrates shear connections 98 of the diaphragm 90 of FIG. 23 that can include energy dissipation devices and systems as described herein. The shear connections 98 can also provide mutual support to gravity loads while transmitting shear within the plane of the deck typical of standard shear connection, and can improve response and dissipation of shear forces due to natural forces including seismic activity. Though illustrated with only a small number of shear connections 98 that incorporate one or more energy dissipation devices at each connection location, some or all shear connections of a diaphragm can incorporate energy dissipation devices for improved response to shear forces.

Figure 25:
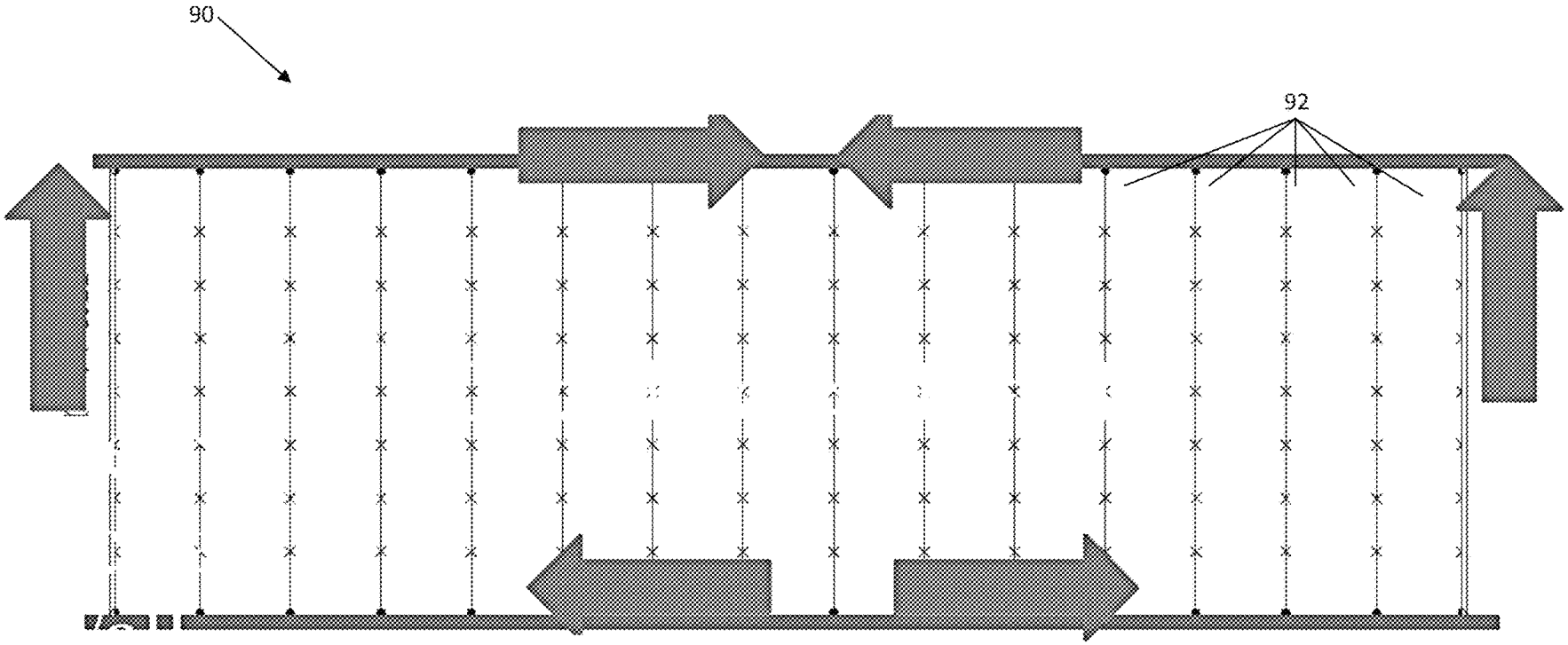
FIG. 25 illustrates a diaphragm as disclosed herein including illustration of combined compression/tension and shear forces as may be encountered during an earthquake.

FIG. 25 illustrates a diaphragm 90 formed of a plurality of pre-formed construction elements 92 showing all connections, both chord connections and shear connections, marked with an X. Through inclusion of one or more passive energy dissipaters in the connections, a diaphragm 90 can better withstand large and inertial, flexure and shear forces, as indicated by the directional arrows, in seismic categories C or beyond, in accordance with ASCE 7-16.

The present disclosure may be better understood with reference to the Examples set forth below.

Example 1

Figure 26:
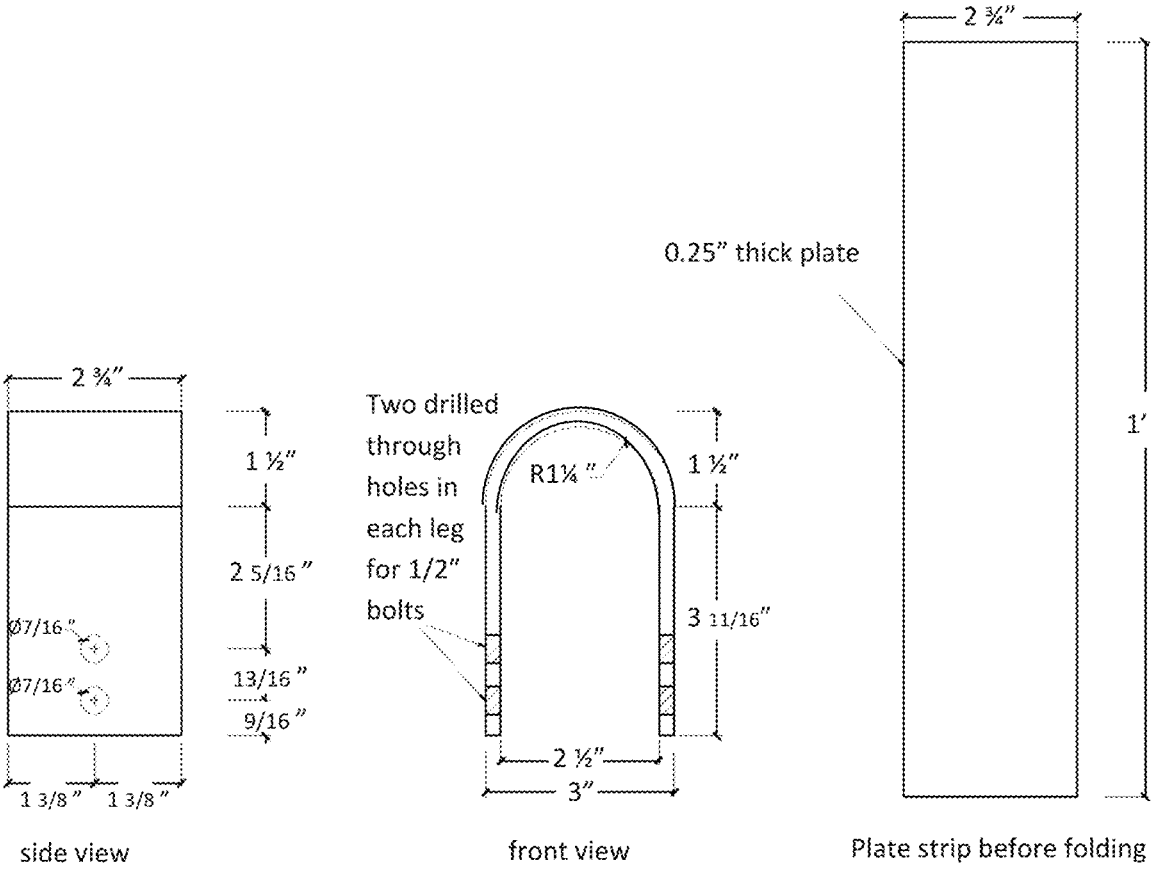
FIG. 26 illustrates the dimensions of UFPs utilized in examples described herein.

UFPs of a mild steel (A36), aluminum alloy (5052), titanium alloy ($Ti_6Al_4V$), and stainless steel (304) were formed and examined for use in connections as described herein. To form the UFPs, single plates of each material were bent and two drill holes were formed on each leg sized for ⅜" bolts. Plates used were 0.25" in thickness and 2¾" in width (FIG. 26). Following bending, each UFP was 5.1875 inches in height and 3 inches in outside width.

Figure 27:
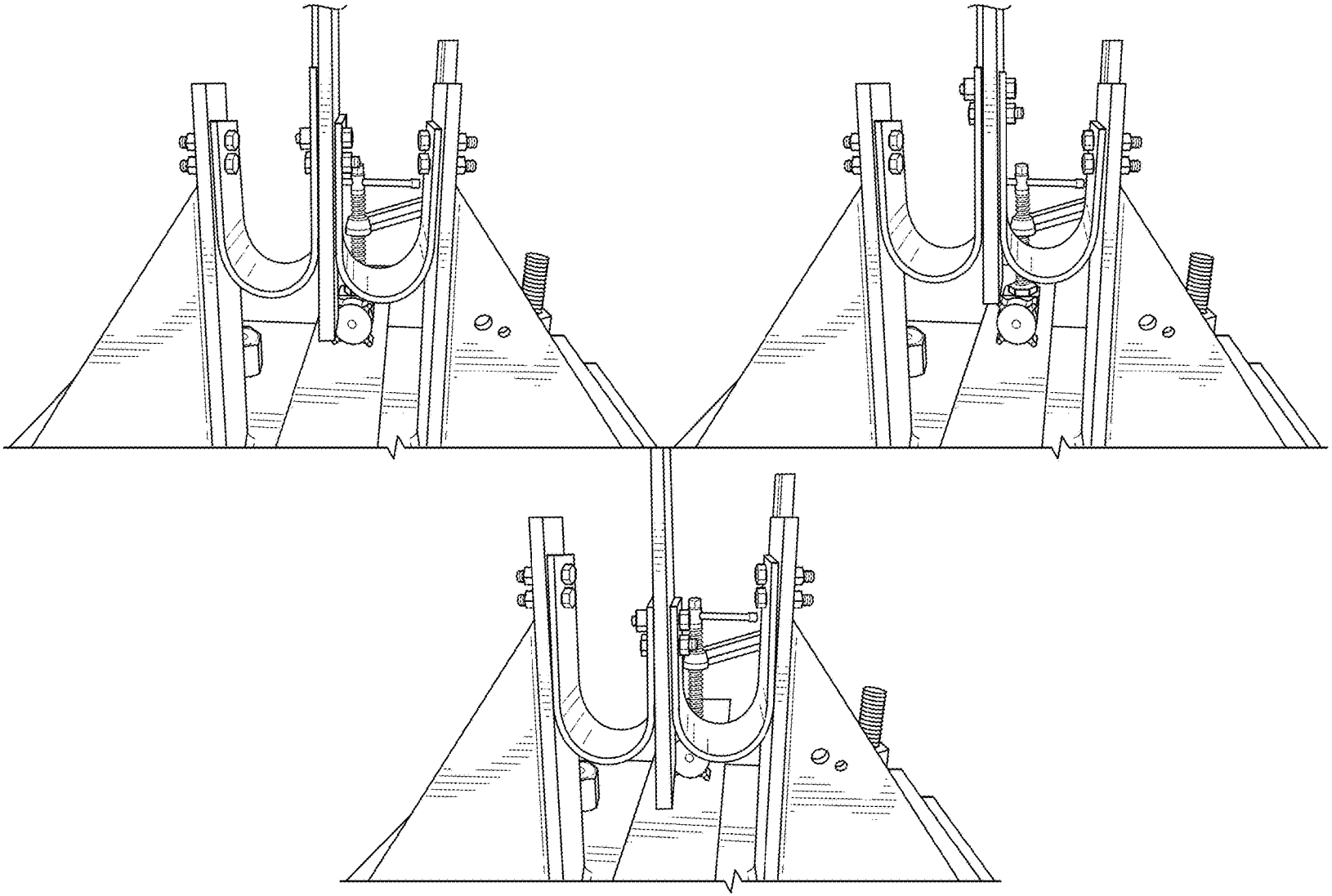
FIG. 27 illustrates a testing set-up for examination of UFPs of several different materials.
Figure 28:
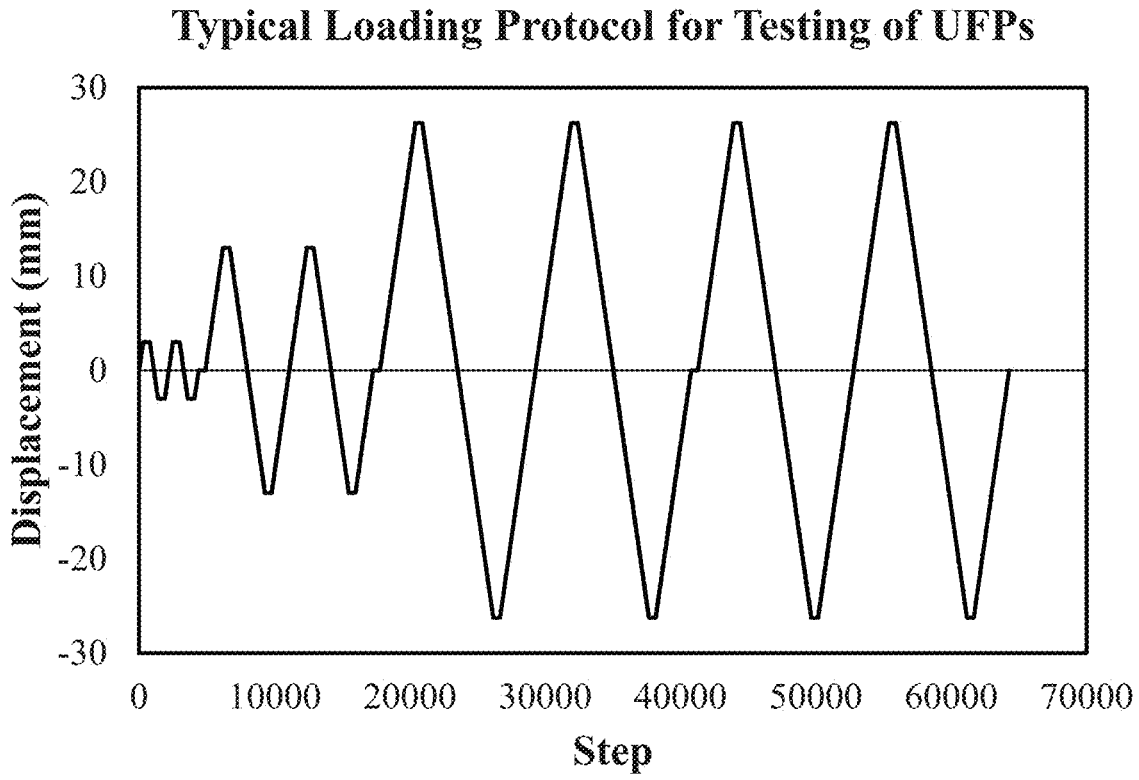
FIG. 28 illustrates the displacement loading protocol used in examination of UFPs of several different materials.

The general test set up is illustrated in FIG. 27. The first image (top left) shows two UFPs bolted to the testing device in a neutral position. During testing, each UFP was repeatedly stressed in both directions, as shown, at increasing displacements. The loading protocol is graphically illustrated in FIG. 28.

Figure 29:
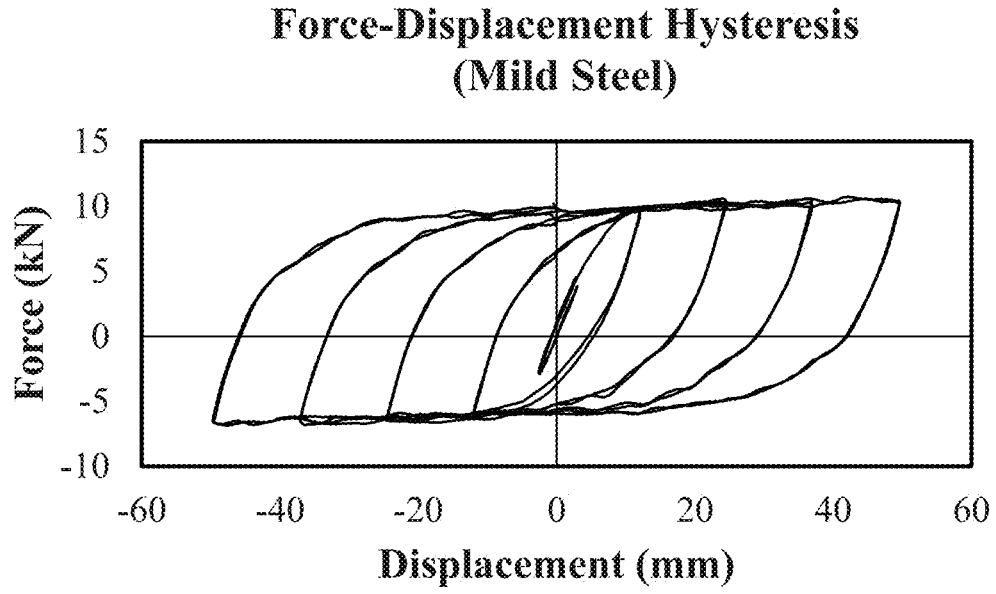
FIG. 29 illustrates hysteresis properties of a mild steel UFP under the loading protocol of FIG. 28.
Figure 30:
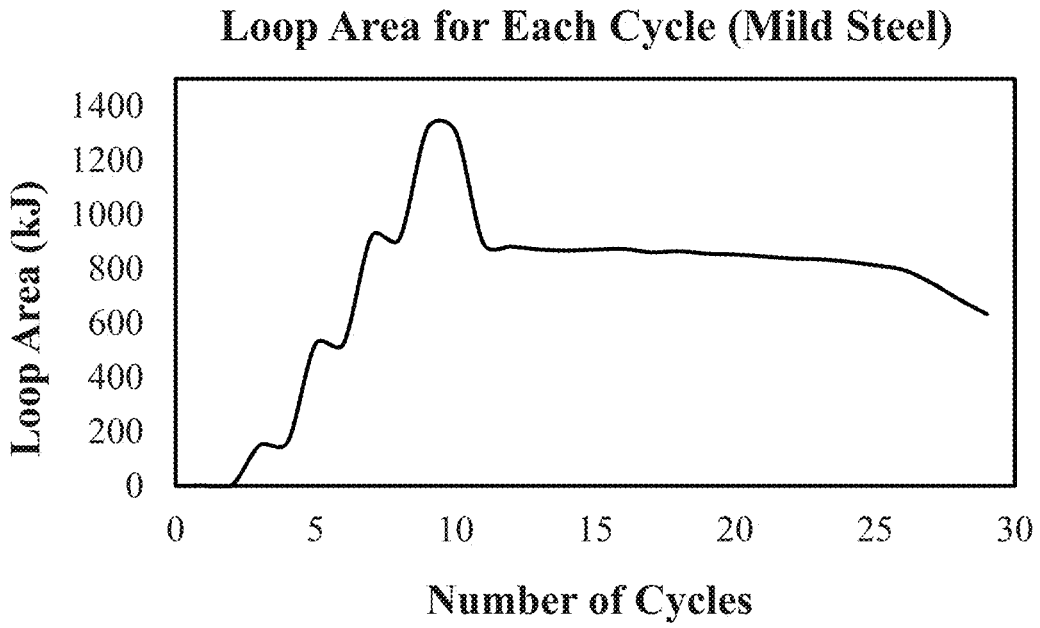
FIG. 30 illustrates the area under each loop of the hysteresis graph (dissipated energy) of FIG. 29.
Figure 31:
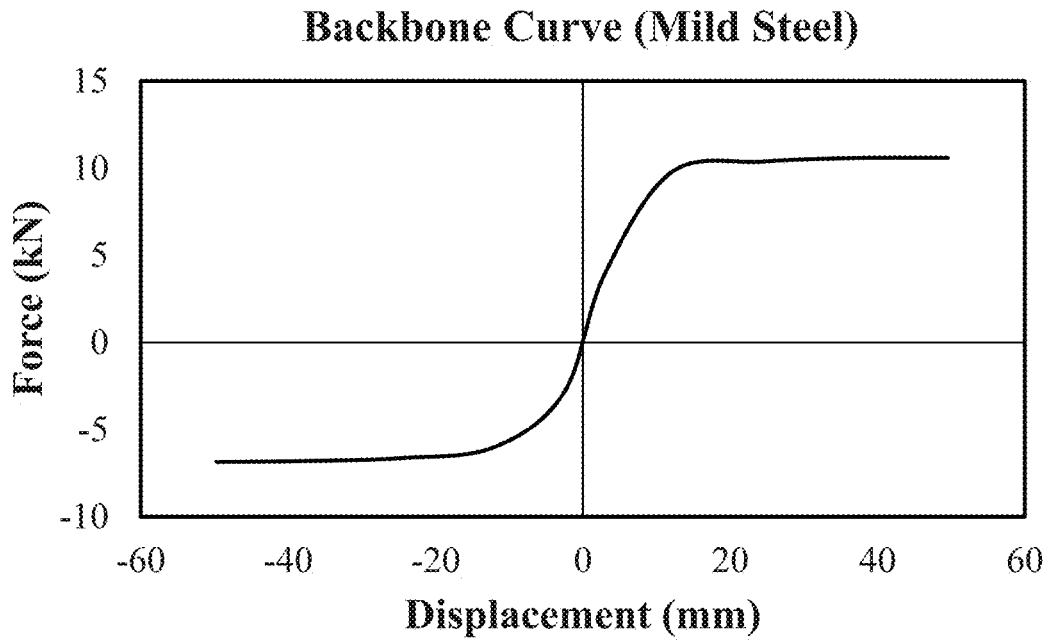
FIG. 31 illustrates the backbone curve for the mild steel UFP.
Figure 32:
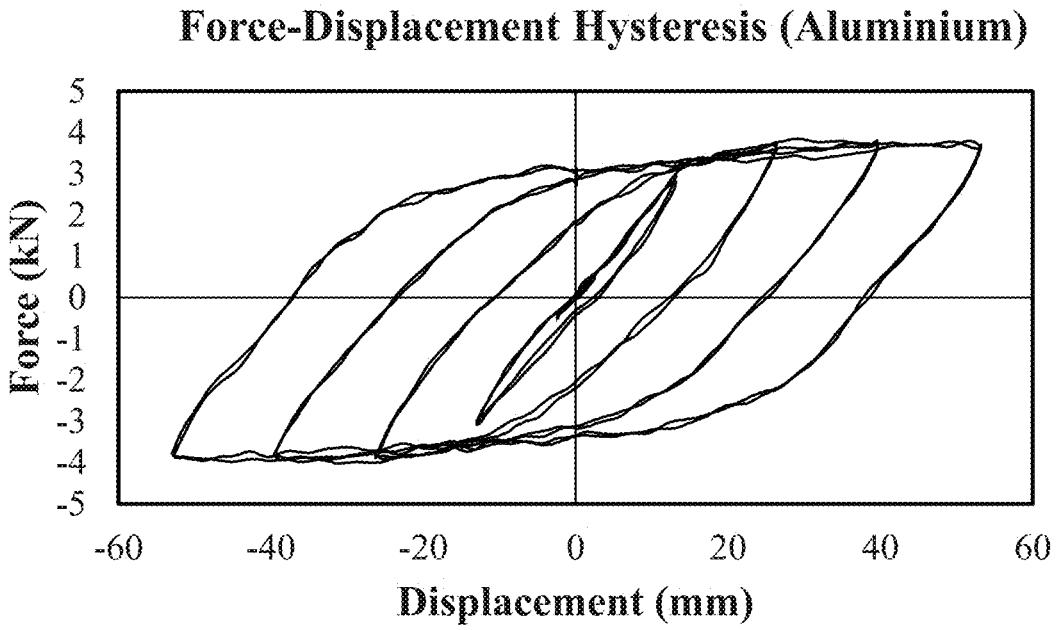
FIG. 32 illustrates hysteresis properties of an aluminum UFP under the loading protocol of FIG. 28.
Figure 33:
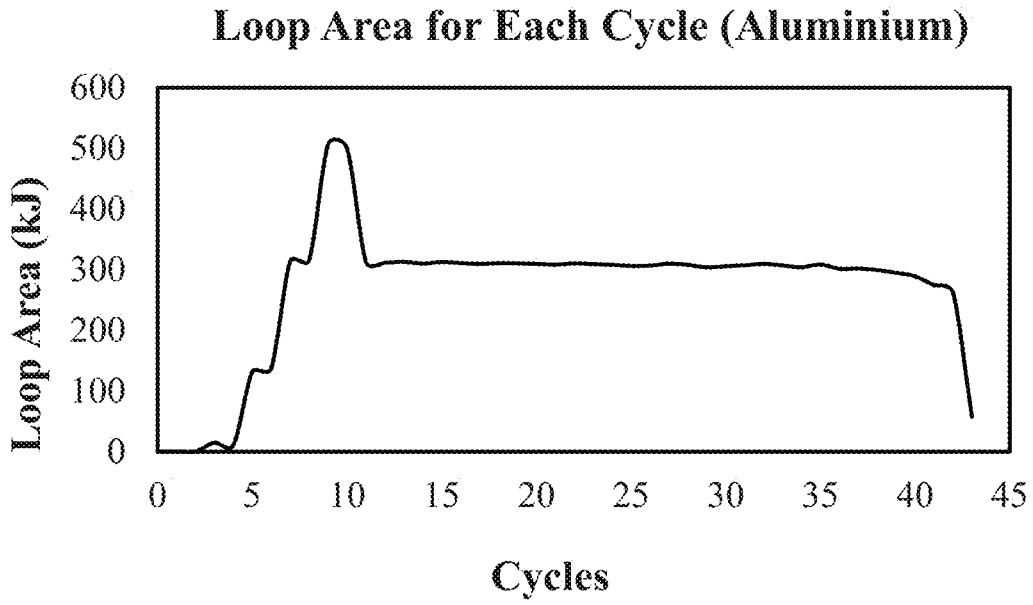
FIG. 33 illustrates the area under each loop of the hysteresis graph of FIG.
Figure 34:
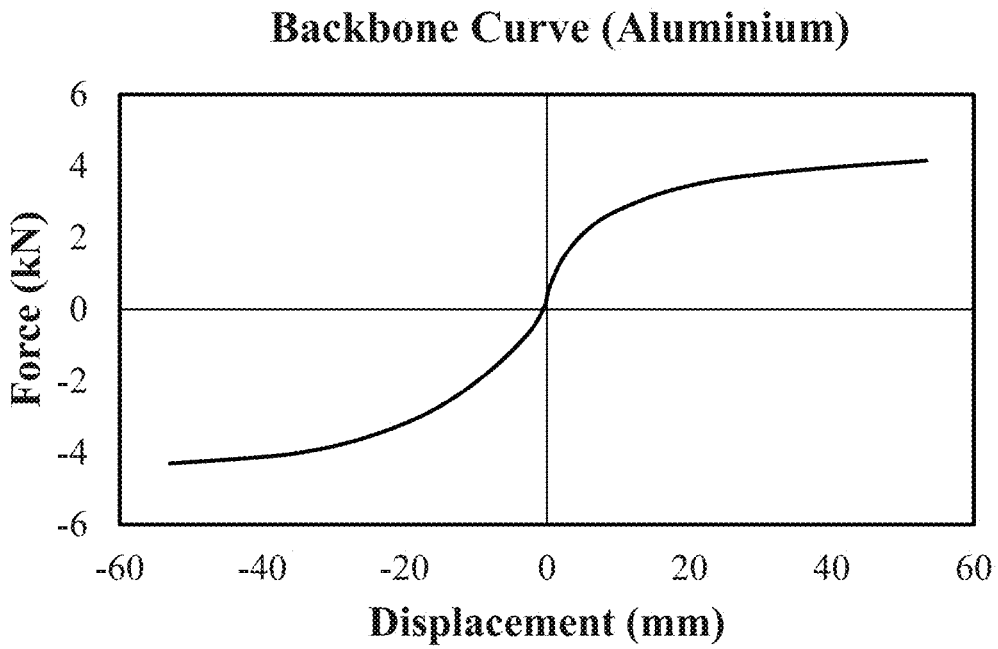
FIG. 34 illustrates backbone curve for the aluminum UFP.
Figure 35:
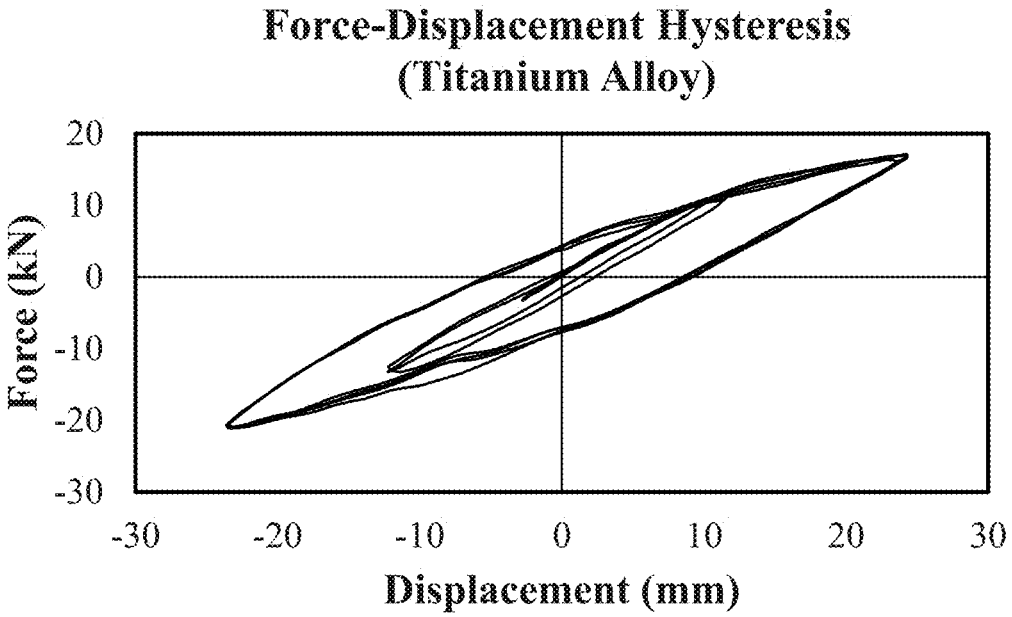
FIG. 35 illustrates hysteresis properties of a titanium alloy ($Ti_6AL_4V$) UFP under the loading protocol of FIG. 28.
Figure 36:
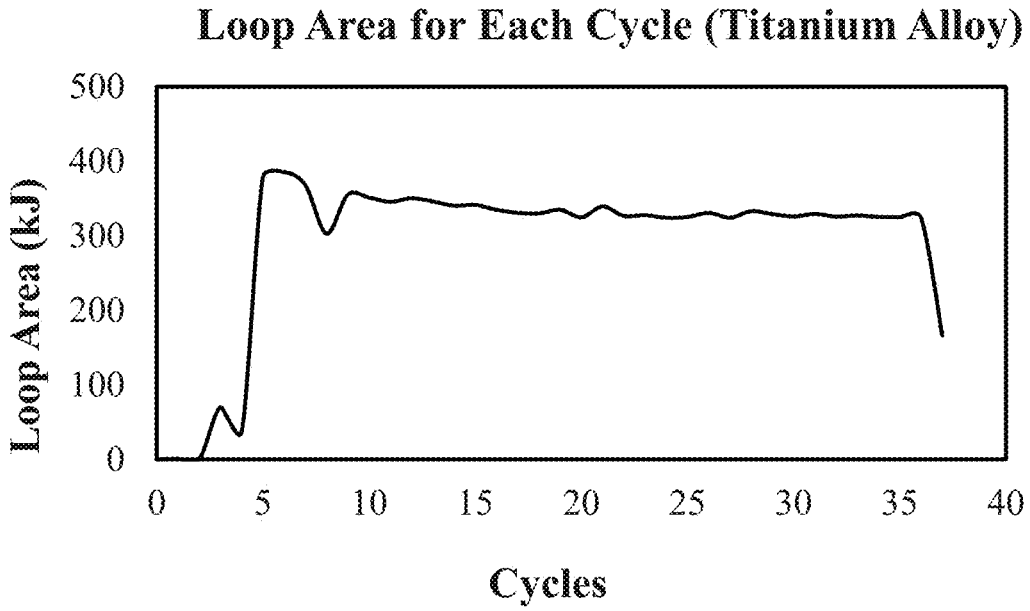
FIG. 36 illustrates the area under each loop of the hysteresis graph of FIG. 35.
Figure 37:
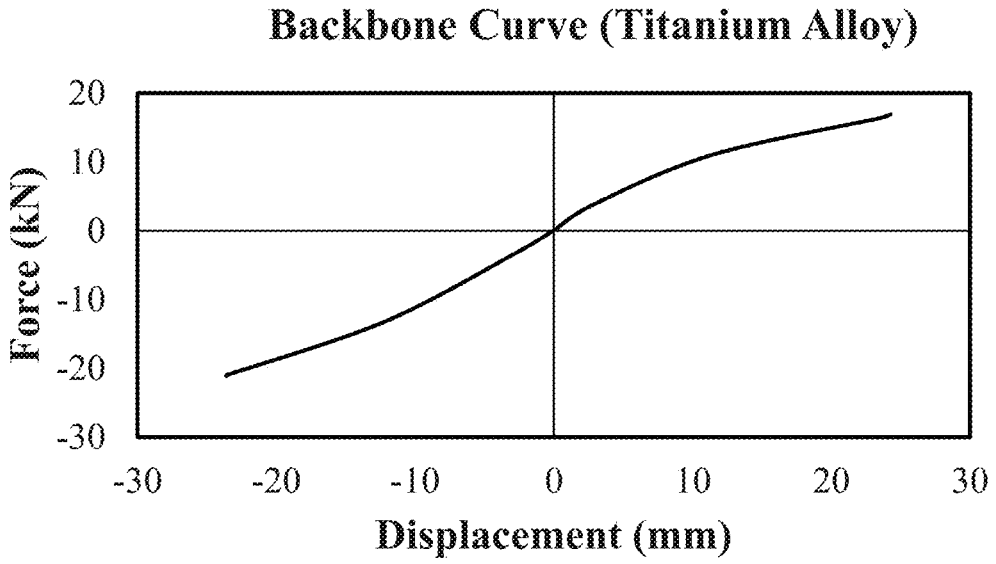
FIG. 37 illustrates the backbone curve obtained for the titanium alloy ($Ti_6AL_4V$) UFP.
Figure 38:
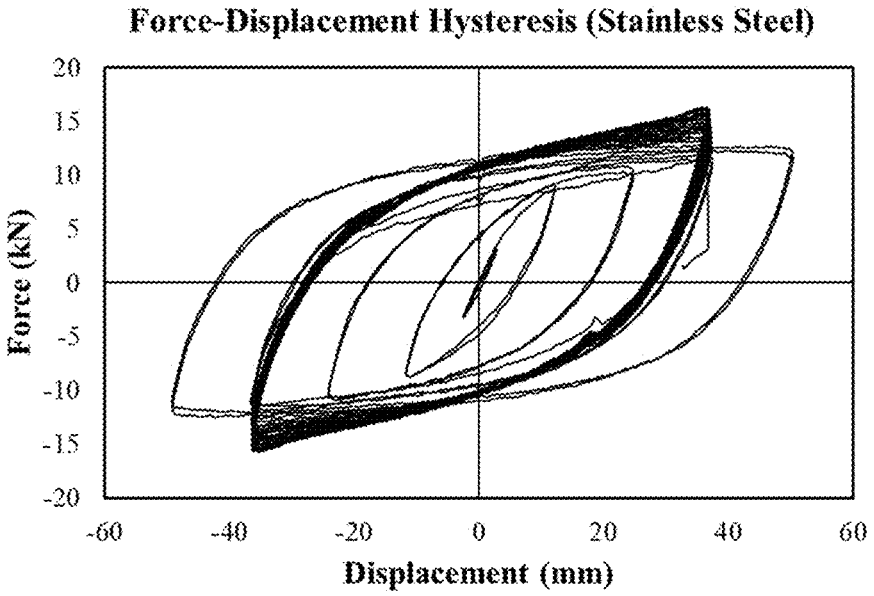
FIG. 38 illustrates hysteresis properties of a stainless steel UFP under the loading protocol of FIG. 28.
Figure 39:
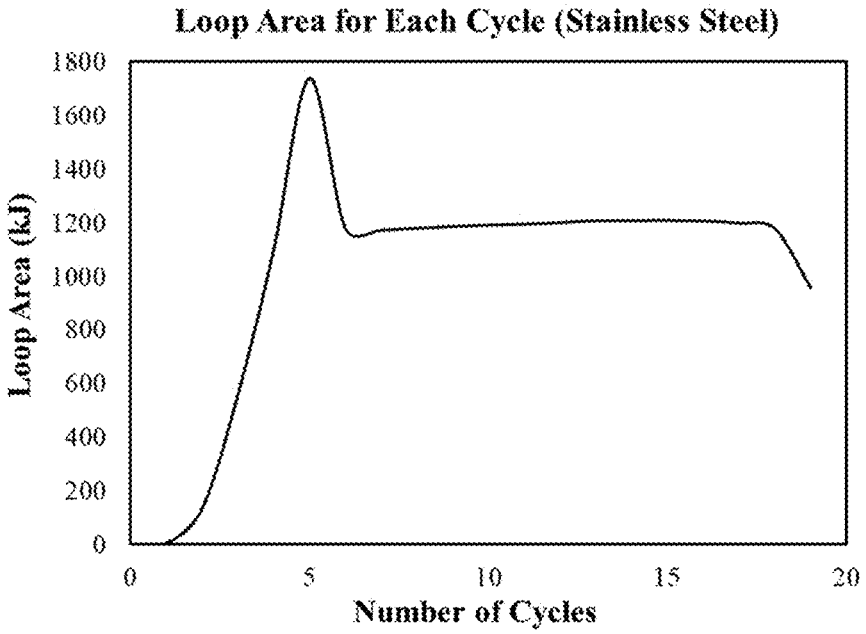
FIG. 39 illustrates the area under each loop of the hysteresis graph of FIG. 38
Figure 40:
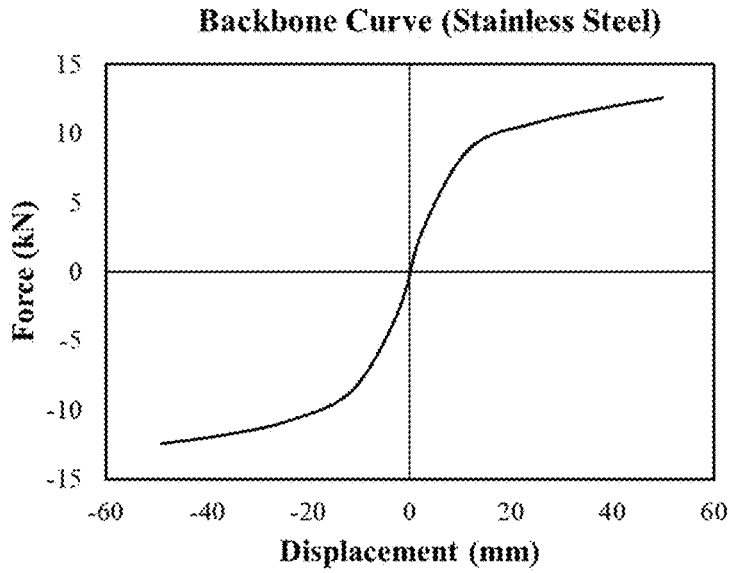
FIG. 40 illustrates the backbone curve obtained for the stainless steel UFP.
Figure 41:
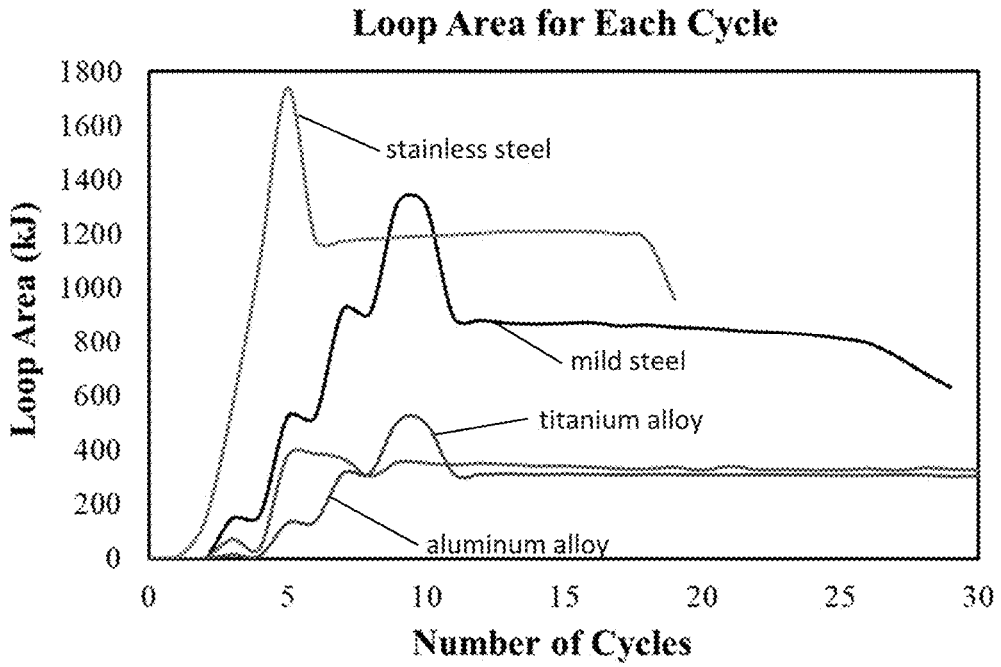
FIG. 41 compares the loop area for each cycle for the UFPs of the different tested materials including mild steel, titanium alloy, aluminum alloy, and stainless steel.
Figure 42:
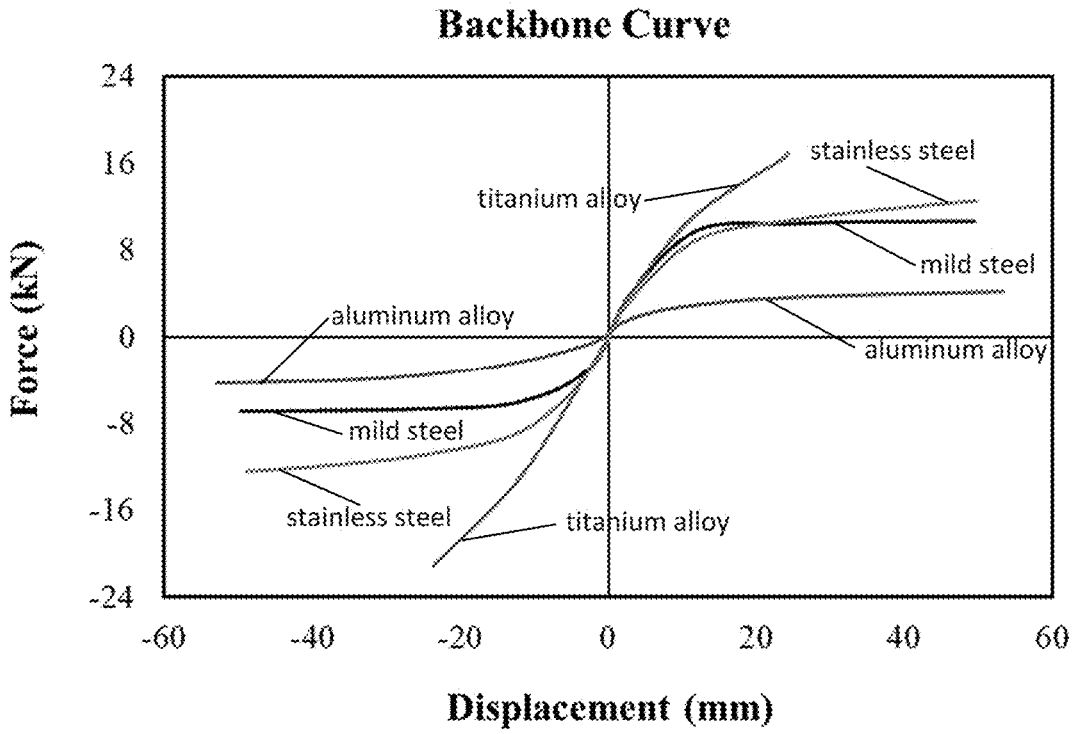
FIG. 42 compares the backbone curves for the UFPs of the different tested materials including mild steel, titanium alloy, aluminum alloy, and stainless steel.

Results for each material are provided in FIG. 29, 30, 310 for the mild steel, FIG. 32, 33, 34 for the aluminum alloy, FIG. 35, 36, 37 for the titanium alloy ($Ti_6AL_4V$), and FIG. 38, 39, 40 for the stainless steel. FIG. 41 and FIG. 42 compare the loop area (dissipated energy) for each cycle for the UFPs and the backbone curves for the UFPs of the different tested materials, respectively.

Example 2

Two bar dissipaters were fabricated for quasi-static cyclic testing. One specimen (GD-1) was tested under net positive displacement, while the other one (GD-2) was tested under net positive and negative displacement. The dimensions were identical for both dissipaters. All dissipater parts (grooved bar and confining tube) were made of mild steel with yield strength of 350 MPa.

Figure 43:
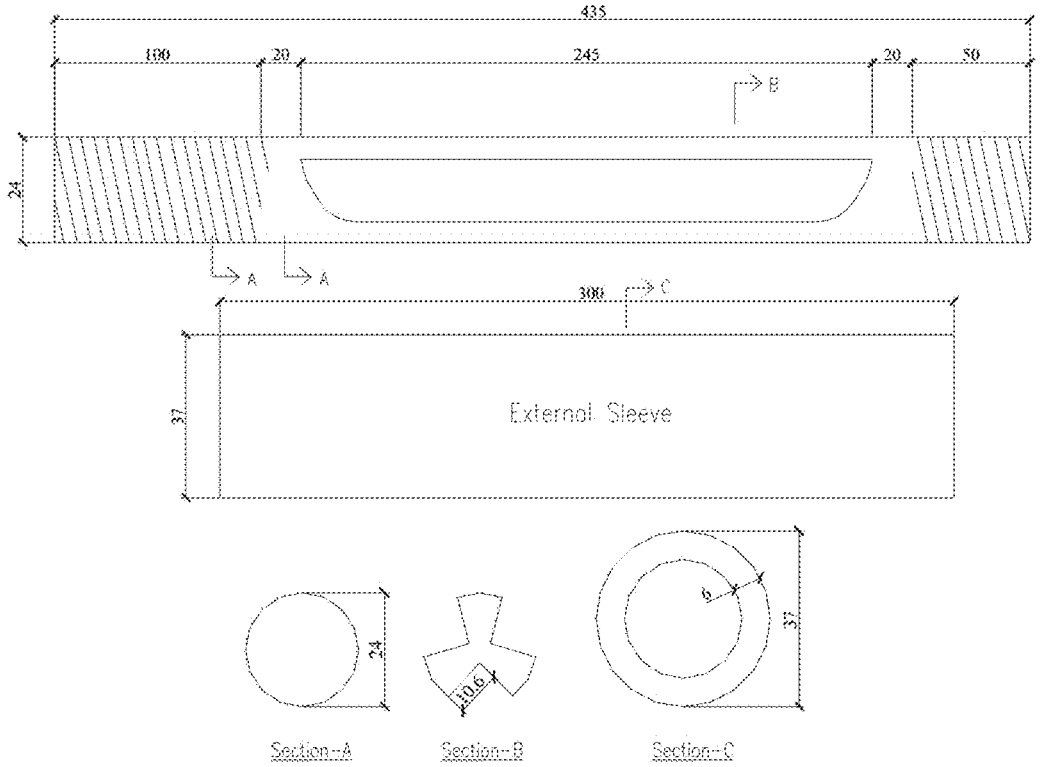
FIG. 43 presents the dimensions of bar dissipaters utilized in the Examples section.

FIG. 43 presents the dimensions and details of the dissipaters. The diameter of the solid bar was 24 mm. Three grooves, each with a depth of 10.6 mm, were cut into the solid bar. This gave a reduced sectional area of 203 $mm^2$ for the dissipater in these areas. The confining tube wall thickness was taken to be 6 mm. The grooved length of the dissipaters was selected such to limit the peak strain in the bar to 5% or lower under displacement levels of 10 mm and 6 mm (assumed to be ultimate state "ULS") for GD-1 and GD-2, respectively. The maximum considered earthquake (MCE) displacements were assumed to be 20 mm and 10 mm, for GD-1 and GD-2, respectively. The reason behind targeting two different displacement levels was that GD-2 was subjected to a more demanding loading (both positive and negative displacements) which normally does not occur in dissipative chord connection (FIG. 45 (*b*)).

Using basic engineering mechanics, the capacity of the dissipaters was estimated to be 71 kN at the yield point. Assuming an overstrength factor of 1.3, the capacity of GD-1 was estimated to be 92 kN at the maximum displacement under net positive deformation. Given the similarity of the bar dissipaters to those studied by Amaris-Mesa (Amaris-Mesa, D.A. 2010. Developments of Advanced Solutions for Seismic Resisting Precast Concrete Frames, PhD Thesis, University of Canterbury, Christchurch, New Zealand.) and Sarti et al. (Sarti, F., et al., D.M. 2013. Experimental and analytical study of replaceable Buckling-Restrained Fuse-type (BRF) mild steel dissipaters, 2013 NZSEE Conference, 8), the capacity of GD-2 was expected to increase by a factor of 2 in compression. This means the capacity of GD-2 under maximum net negative strain was estimated to be about 150 kN.

Figure 44:
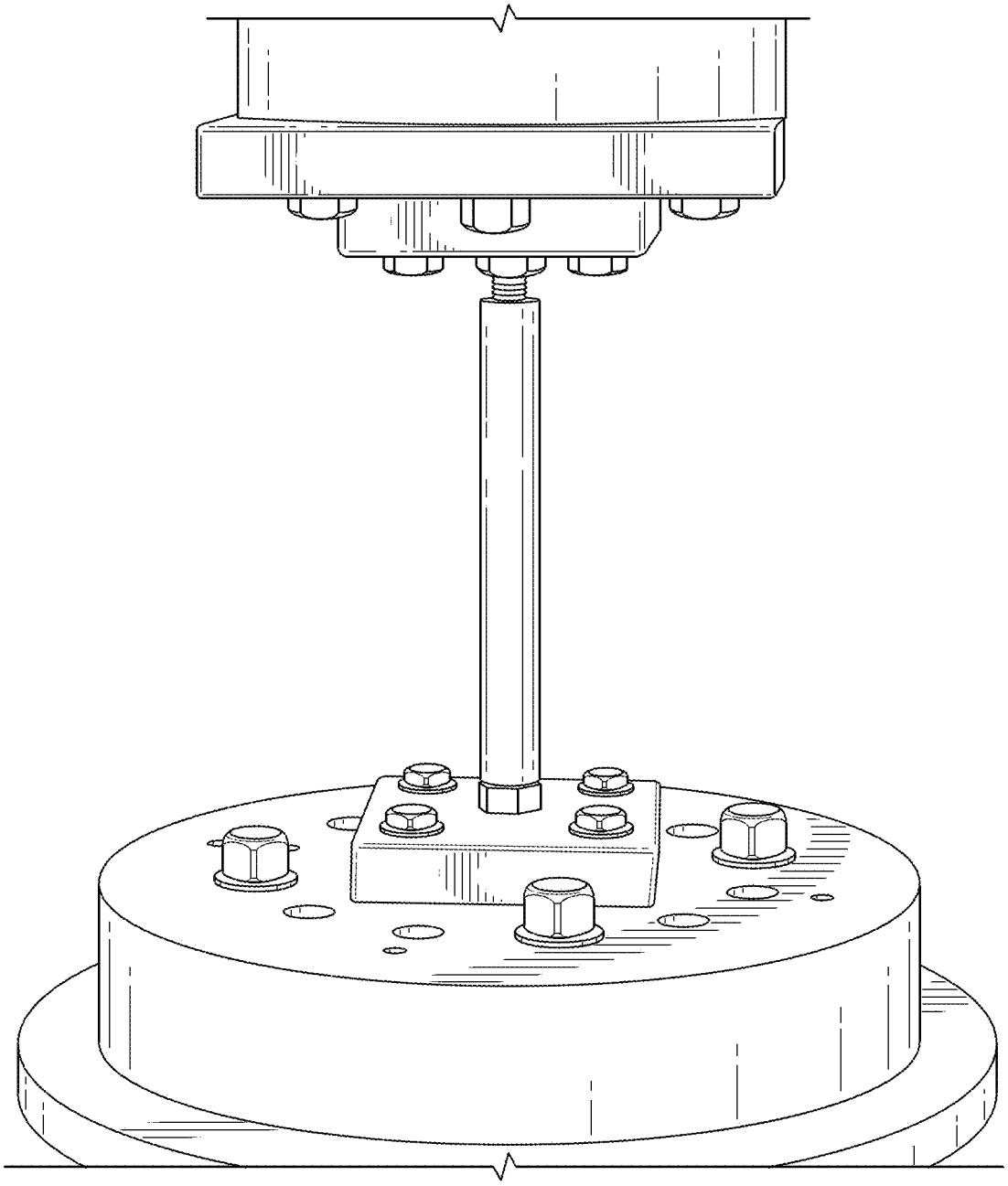
FIG. 44 illustrates a bar dissipater under testing.
Figure 45:
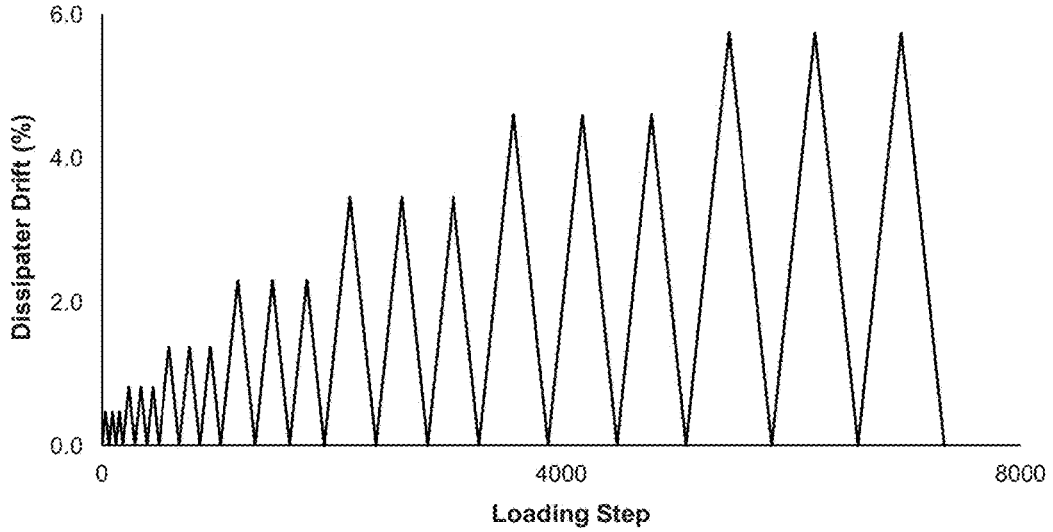
FIG. 45 illustrates the loading protocol for a first bar dissipater (GD-1) at (a) and a second bar dissipater (GD-2) at (b) examined in the Examples section.
Figure 45:
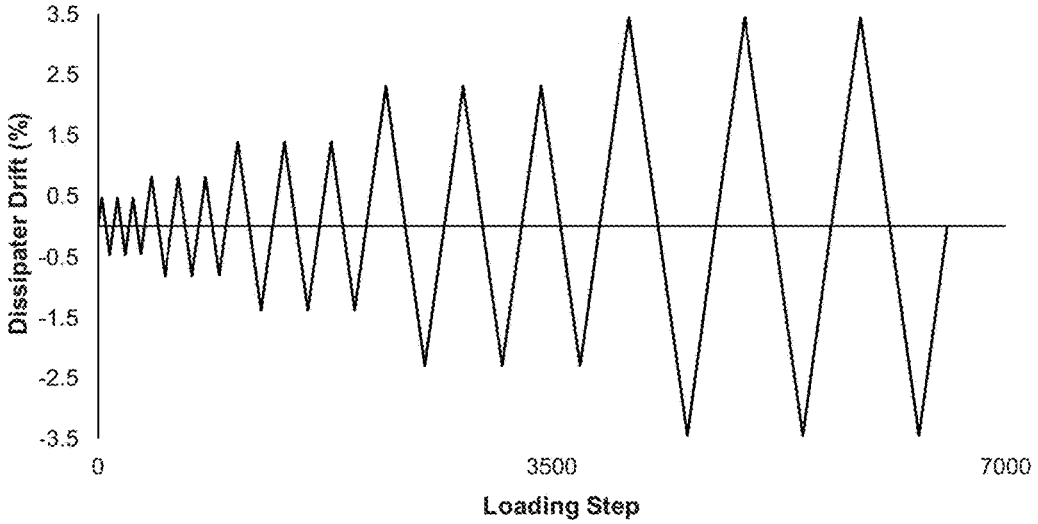

Testing arrangement was similar to that conducted by (Sarti et al.) as shown in FIG. 44. The dissipaters were tested under axial loading under the 10 MN DARTEC test machine at the University of Canterbury. During testing, the axial force and displacement were monitored for each dissipater until the fracture point. Loading protocol for each dissipater was cyclic quasi-static and is shown in FIG. 45.

Figure 46A:
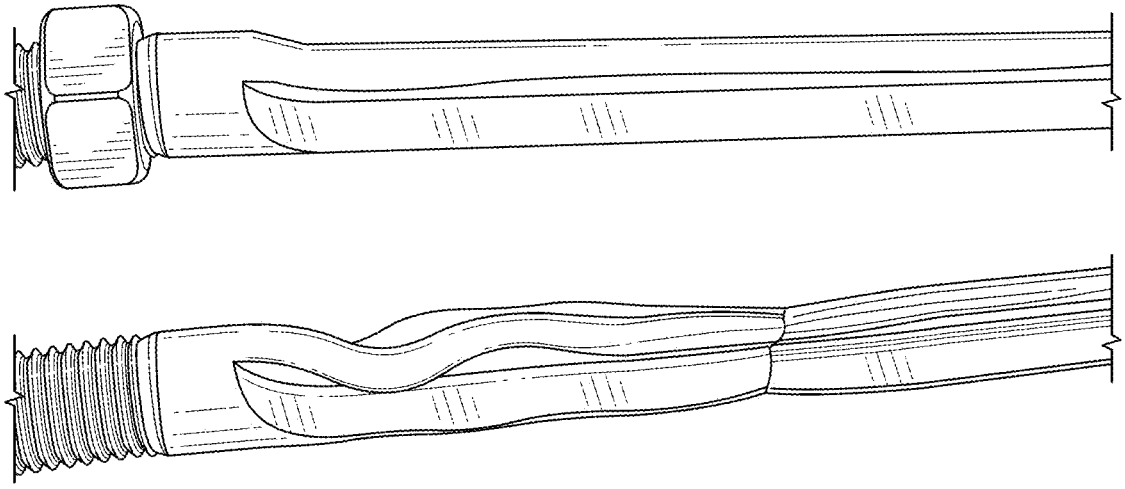
FIG. 46 illustrates snake-shape local buckling and fracture of bar dissipaters tested herein (GD-1 at (a) and GD-2 at (b)).
Figure 46B:
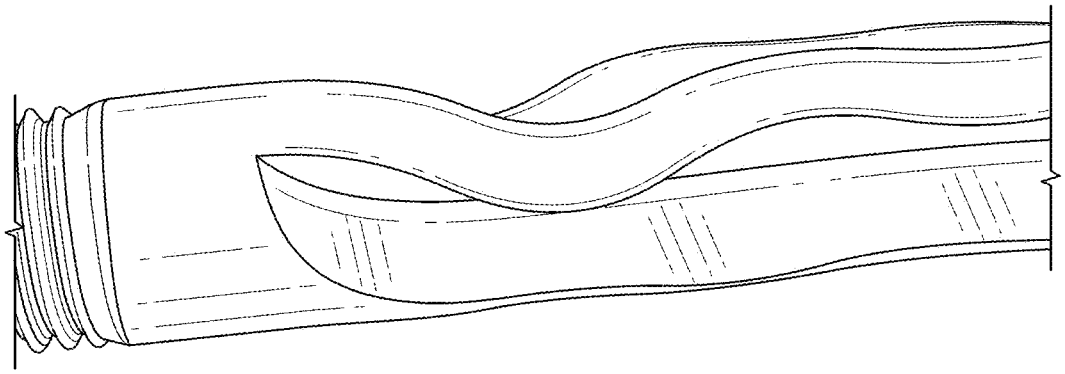

Testing results for GD-1 showed that the dissipater completed all loading cycles up until cycles of 25 mm (1 in.) displacement. The dissipater fractured during the second cycle of 25 mm (1 in.) displacement. The fracturing cause was due to strength degradation and local buckling under cycles of high strains. Upon conclusion of the testing, evidence of snake-shape local buckling along the grooved length of the dissipater was noticed (FIG. 46). Testing results for GD-2 showed that the dissipater reached maximum displacement of 15 mm (0.6 in.) under net negative strain, but fractured as the dissipater was loaded to a similar displacement under net positive (tension) strain. The fracture was thought to be due to low-cycle fatigue and local buckling along the grooved length. The local buckling in GD-2 was more obvious and severe (FIG. 46 at (*b*)) than what observed in testing of GD-1 (FIG. 46 at (*a*)). Both samples can be classified as HDE due to their deformation capacity of 0.6 in. or greater under tension forces.

Figure 47:
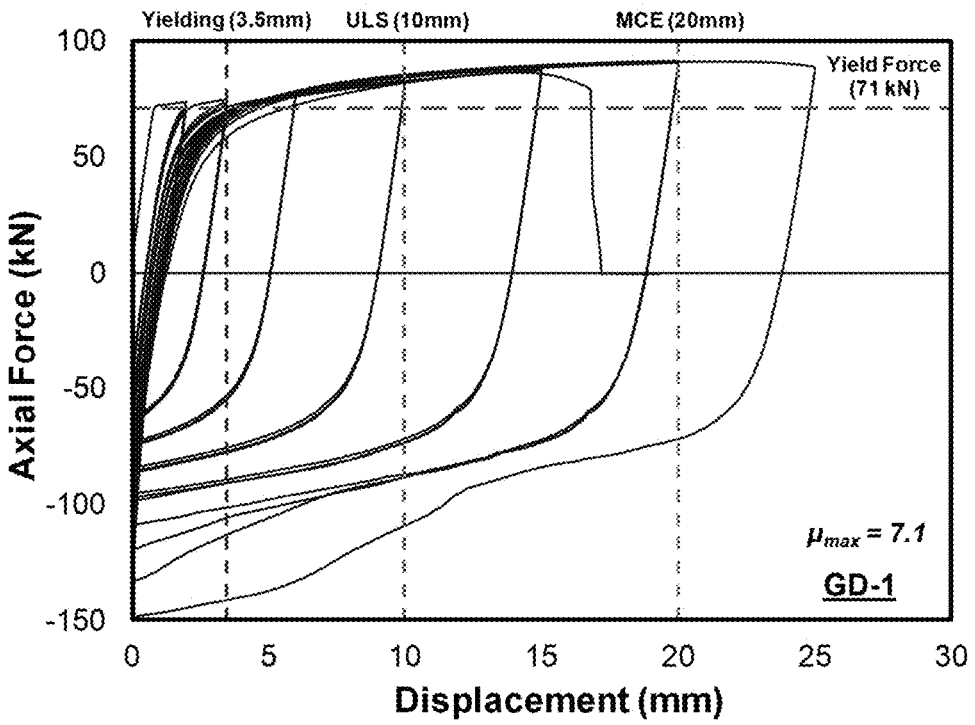
FIG. 47 presents the force-displacement hysteresis for the GD-1 bar dissipater under net positive displacement.
Figure 48:
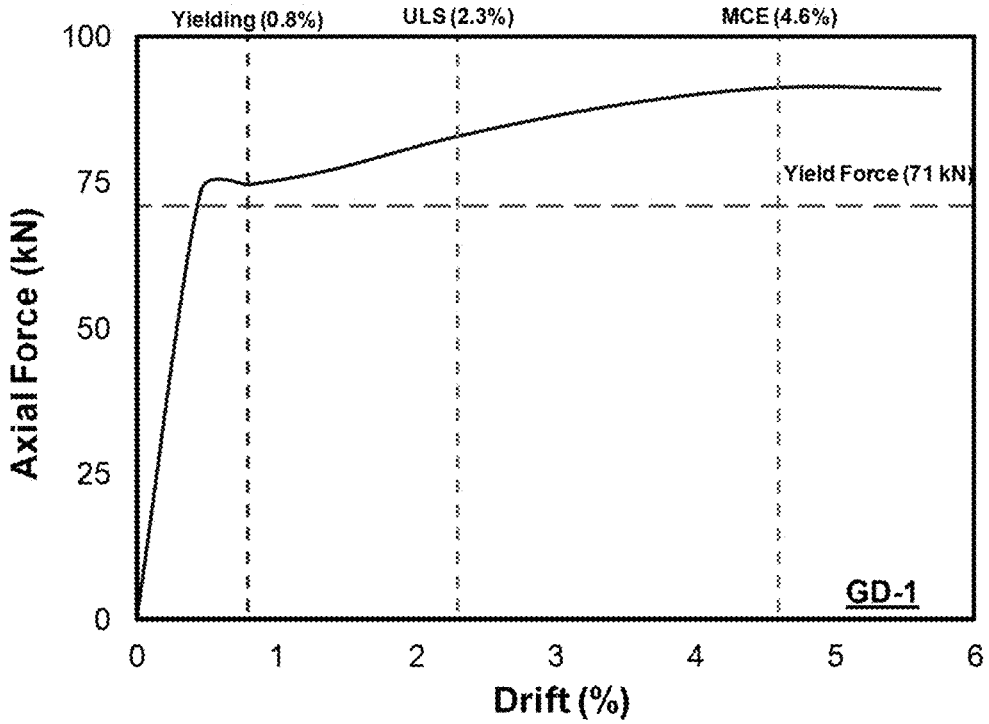
FIG. 48 presents the backbone curve for the GD-1 bar dissipater.

The axial force-displacement hysteresis for GD-1 under net positive strain is plotted in FIG. 47. The dissipater showed a stable hysteresis. The backbone curve is shown in FIG. 48. Considering the lower yield point on the backbone curve, the dissipater yielded at approximately 0.8% drift ratio or 3.5 mm. The drift ratio was calculated by dividing displacements to overall length of the dissipater (435 mm). GD-1 achieved a maximum capacity of just less than 100 kN in tension, and approximately a capacity of 150 kN in compression during the first cycle of 25 mm displacement (5.7% drift ratio). The ductility at the maximum displacement (μmax) was 7.1. The residual displacement in the dissipater following the first cycle of 5.7% drift ratio was in order of 23.7 mm (5.45% drift ratio) which corresponded to 95% of the 5.7% drift ratio.

Figure 49:
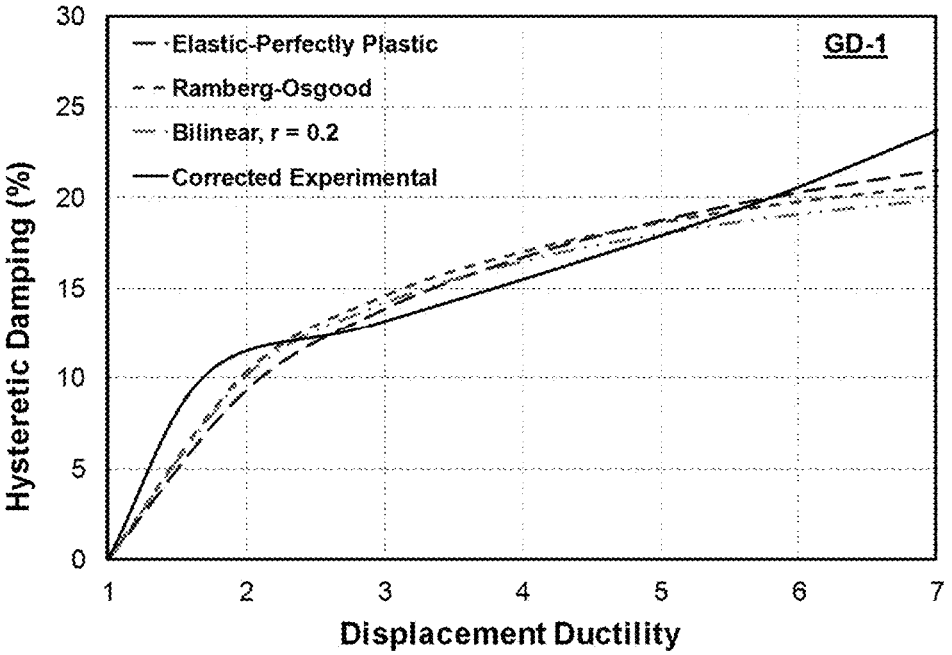
FIG. 49 presents the corrected area-based hysteretic damping for the GD-1 bar dissipater.
Figure 50:
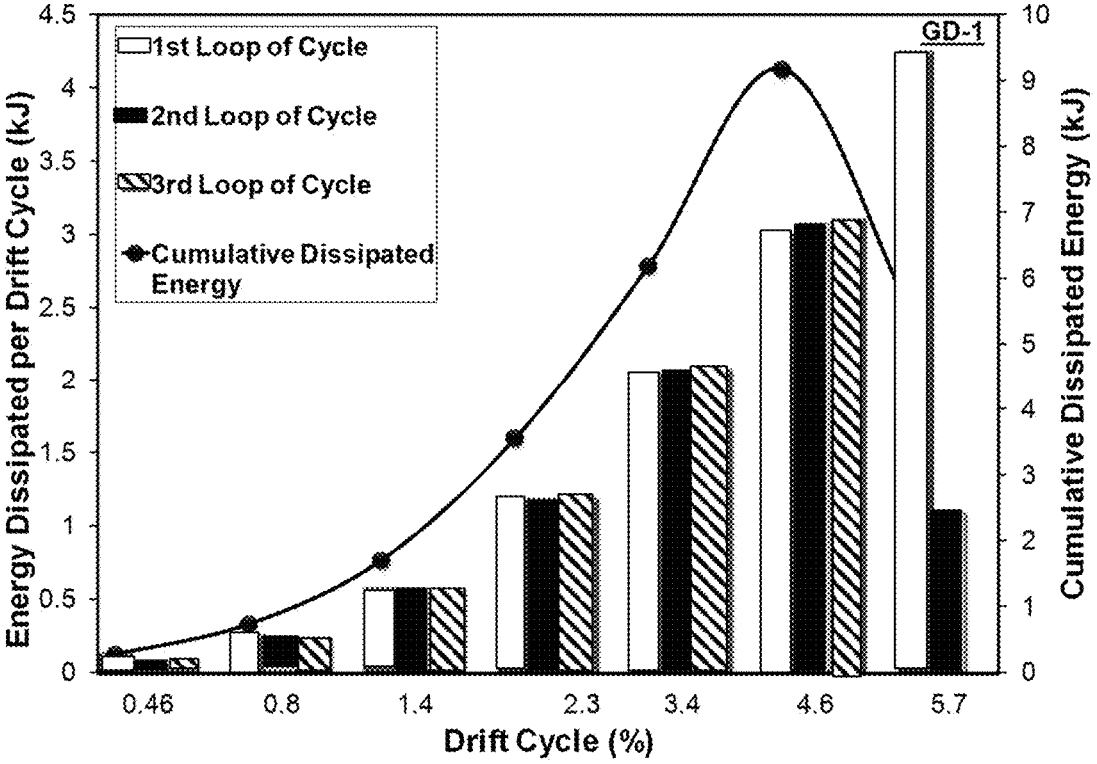
FIG. 50 presents the dissipated energy for the GD-1 bar dissipater.

The experimental hysteretic damping curve for GD-1 is plotted in FIG. 49. For ductility values of 1 up to 2.5, the hysteretic damping values for the dissipater were above those from existing theoretical models for elastic-perfectly plastic, Ram berg-Osgood, and bilinear (r=0.2). For ductility values of 2.5 up to 5.5, the values for hysteretic damping were just under the theoretical models. For ductility beyond 5.5, the hysteretic damping values were above the theoretical models up to the fracturing point. GD-1 attained a maximum hysteretic damping value of 24% at ductility of 7.1 during first cycle at maximum drift ratio of 5.7% (25 mm displacement). The energy dissipated per each cycle of each drift ratio for GD-1 derived from the experimental results is presented in FIG. 50. The cumulative dissipated energy in this figure was plotted by summing up the energy dissipated per each drift ratio.

Figure 51:
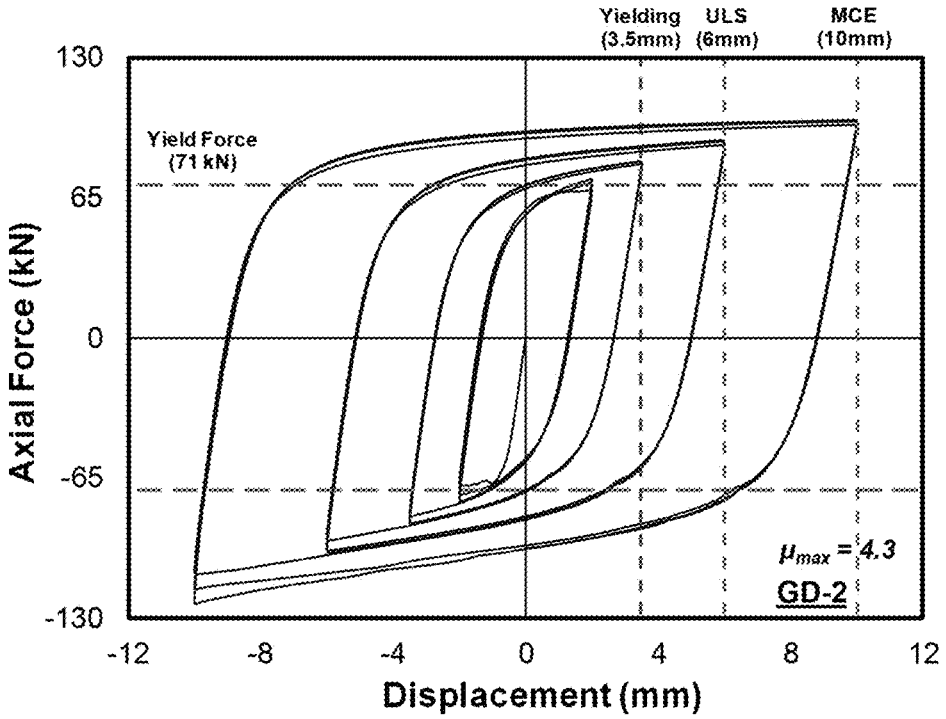
FIG. 51 presents the force-displacement hysteresis for the GD-2 bar dissipater under net positive and negative displacement.
Figure 52:
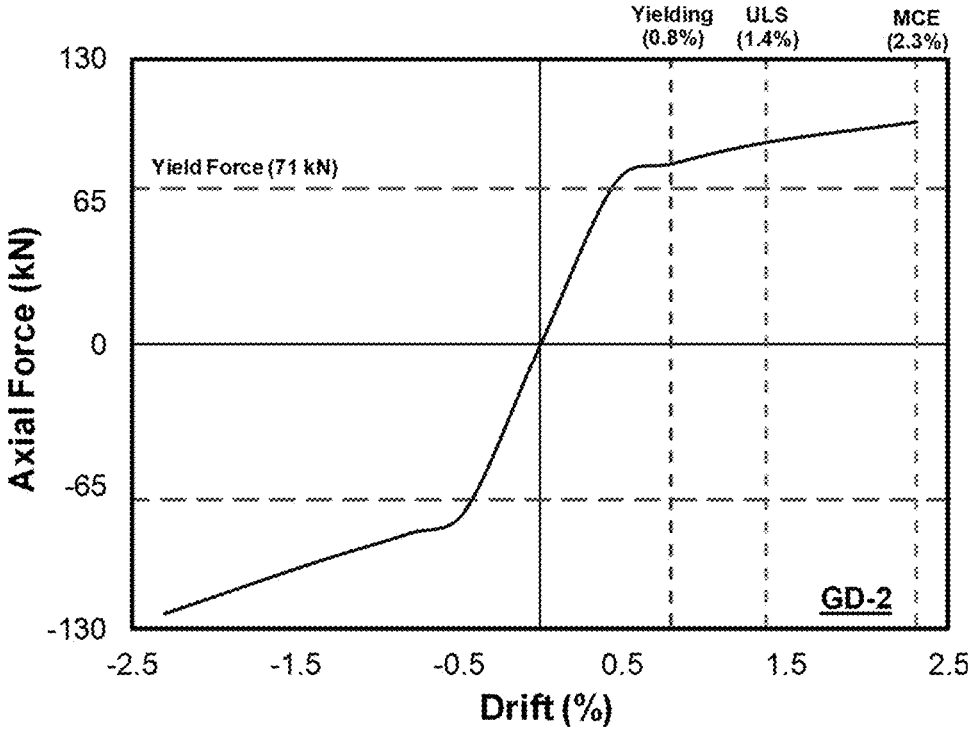
FIG. 52 presents the backbone curve for the GD-2 bar dissipater.
Figure 53:
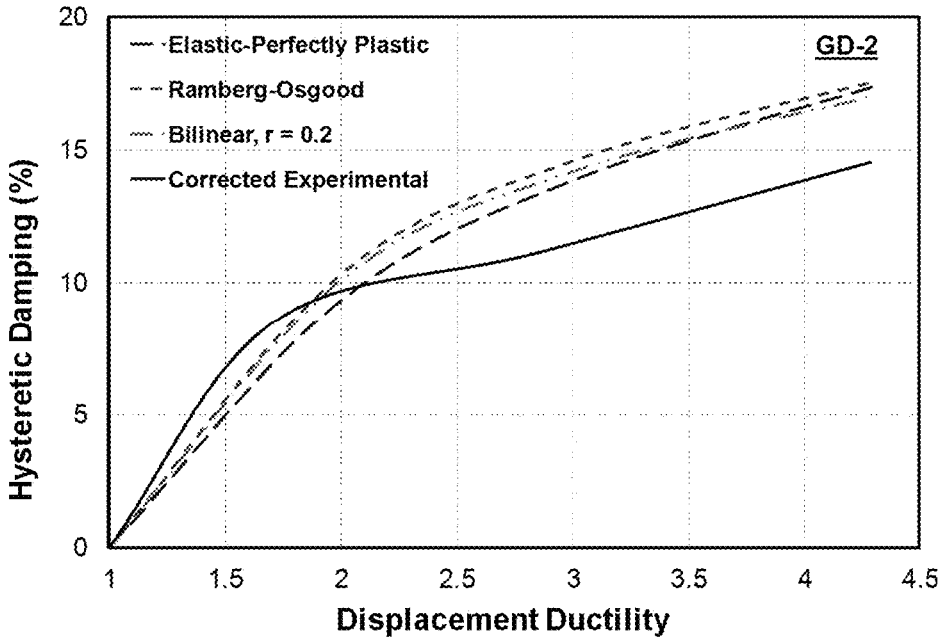
FIG. 53 presents the corrected area-based hysteretic damping for the GD-2 bar dissipater.
Figure 54:
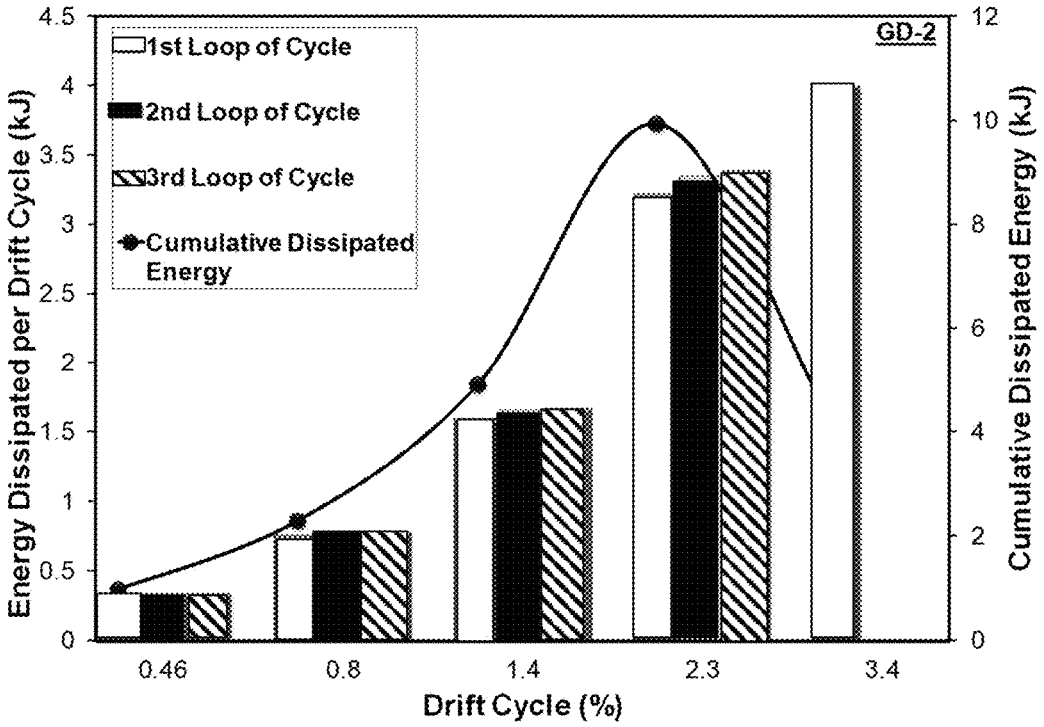
FIG. 54 presents the dissipated energy for the GD-2 bar dissipater.

For GD-2, the axial force-displacement and backbone plots are presented in FIG. 51 and FIG. 52, respectively. The yield point of the dissipater was similar to that of GD-1 (0.8% drift ratio). The dissipater showed a stable response with a slight increase in strength under net negative displacement (compression). The hysteretic damping trend versus theoretical models was similar to GD-1. FIG. 53 and FIG. 54 present plots for hysteretic damping and dissipated energy for GD-2, respectively.

The loading protocol for GD-1 represented a case similar to what can be expected of bar dissipaters in a dissipative chord connection between pre-topped double tees. GD-1 achieved its predicted capacity and maximum displacement ductility of 7.1 before fracturing in low-cycle fatigue during the second cycle of 5.7% drift ratio which corresponded to 25 mm displacement. The maximum drift ratio for which the dissipater could complete all three cycles was at maximum considered level loading was 4.6% drift ratio or 20 mm displacement. The corrected experimental damping curve suggested that the dissipater reached maximum hysteretic damping of 24% before the failure. This was slightly higher than those obtained from theoretical models such as Ramberg-Osgood, elastic-perfectly plastic, and bilinear with (r=0.2).

For GD-2, the specimen was subjected to positive (tension) and negative (compression) displacement which is a more demanding loading protocol. GD-2 showed a stable hysteresis with similar response to that of GD-1. There was a slight increase (22%) in the strength of the dissipater under compression during cycles of maximum considered earthquake level drift ratio (2.3% drift ratio or 10 mm displacement). GD-2 achieved a maximum ductility of 4.3 before fracturing in low-cycle fatigue during the first cycle of 3.4% drift ratio which corresponded to 15 mm displacement. The corrected experimental damping values were slightly lower than those observed in testing of GD-1 because of lower levels of displacement. Before fracturing in low-cycle fatigue, the dissipater attained a maximum hysteretic damping of 14%. Observations from testing showed larger snake-shape local buckling in the grooved portion of the dissipater in GD-2 compared to GD-1.

The testing results demonstrate that bar dissipaters offer advantages such as higher capacity in a smaller package, easy fabrication, and good energy dissipation.

While certain embodiments of the disclosed subject matter have been described using specific terms, such description is for illustrative purposes only, and it is to be understood that changes and variations may be made without departing from the spirit or scope of the subject matter.

What is claimed is:

1. A passive hysteretic damper comprising:

a U-shaped flexural plate formed of a first material comprising a metal or a metal alloy and having a width between a first edge and a second edge, wherein the U-shaped flexural plate includes a curved portion that extends along a first length of the first edge and a first length of the second edge, a first leg defined by a rectangle that extends across the width and along a second length of the first edge and a second length of the second edge, and a second leg defined by a rectangle that extends across the width and along a third length of the first edge and a third length of the second edge, the first leg extending from a first end of the curved portion, and the second leg extending from a second end of the curved portion, the curved portion joining the first leg to the second leg; and a reinforcement element formed of a second material comprising a metal or a metal alloy, the reinforcement element having a size and shape so as to be nested within the curved portion, wherein upon this nesting, the reinforcement element defines a circle in a transverse plane that passes through the first leg, the curved portion, and the second leg.

2. The passive hysteretic damper of claim 1, wherein the reinforcement element is in the shape of a cylinder.

3. The passive hysteretic damper of claim 1, wherein the U-shaped flexural plate and the reinforcement element are formed of the same material.

4. The passive hysteretic damper of claim 1, wherein the U-shaped flexural plate comprises a mild steel.

5. The passive hysteretic damper of claim 1, wherein the U-shaped flexural plate comprises a steel, aluminum, a titanium alloy, or a stainless steel.

6. The passive hysteretic damper of claim 1, wherein the U-shaped flexural plate comprises a shape memory alloy.

7. The passive hysteretic damper of claim 1, wherein the reinforcement element is solid.

8. The passive hysteretic damper of claim 1, wherein the reinforcement element is hollow.

9. The passive hysteretic damper of claim 1, wherein the reinforcement element is attached to the U-shaped flexural plate.

10. The passive hysteretic damper of claim 1, wherein the passive hysteretic damper comprises the U-shaped flexural plate nested within a second U-shaped flexural plate.

11. The passive hysteretic damper of claim 10, further comprising a reinforcement between the U-shaped flexural plate and the second U-shaped flexural plate.

12. The passive hysteretic damper of claim 1, wherein the passive hysteretic damper comprises a double U-shaped flexural plate.

13. A method for forming a load-bearing surface comprising:

attaching the first leg of the passive hysteretic damper of claim 1 to a flange of a first construction element;

connecting a flange of a second construction element to the second leg of the passive hysteretic damper and thereby forming a shear connection between the first and second construction elements.

14. The method of claim 13, wherein the passive hysteretic damper spans the shear connection.

15. The method of claim 13, wherein the passive hysteretic damper is at least partially within the flange of the first construction element.

16. The method of claim 13, wherein the first construction element is a precast double tee.

17. A pre-formed construction element comprising:

a flange and a recess defined within the flange;

a connector, at least a portion of the connector embedded in the flange, a connection surface of the connector being available for forming a connection within the recess; and the passive hysteretic damper of claim 1, wherein upon connection of the first leg of the U-shaped flexural plate to the connection surface, the second leg of the U-shaped flexural plate extends external to the recess, this external portion being configured for connection to a second connection surface of an adjacent pre-formed construction element to form a shear connection.

18. The pre-formed construction element of claim 17, wherein the pre-formed construction element is a precast double tee.

19. The pre-formed construction element of claim 17, wherein the pre-formed construction element is a precast pre-topped double tee.

20. The pre-formed construction element of claim 17, wherein the pre-formed construction element is a diaphragm element.

21. The pre-formed construction element of claim 17, the construction element further comprising a bar dissipater connected to an end of a reinforcing bar embedded in the flange.

* * * * *